US010883395B2

(12) United States Patent
Lichti

(10) Patent No.: US 10,883,395 B2
(45) Date of Patent: Jan. 5, 2021

(54) HYDRAULICALLY BIASED CAMSHAFT PHASER

(71) Applicant: DELPHI TECHNOLOGIES IP LIMITED, St. Michael (BB)

(72) Inventor: Thomas Howard Lichti, Victor, NY (US)

(73) Assignee: DELPHI TECHNOLOGIES IP LIMITED

( * ) Notice: Subject to any disclaimer, the term of this patent is extended or adjusted under 35 U.S.C. 154(b) by 379 days.

(21) Appl. No.: 15/688,017

(22) Filed: Aug. 28, 2017

(65) Prior Publication Data

US 2018/0058274 A1 Mar. 1, 2018

Related U.S. Application Data

(60) Provisional application No. 62/380,662, filed on Aug. 29, 2016.

(51) Int. Cl.
*F01L 1/344* (2006.01)

(52) U.S. Cl.
CPC ..... *F01L 1/3442* (2013.01); *F01L 2001/3443* (2013.01); *F01L 2001/3445* (2013.01); *F01L 2001/34426* (2013.01); *F01L 2001/34433* (2013.01); *F01L 2001/34469* (2013.01)

(58) Field of Classification Search
CPC ..... F01L 2001/34426; F01L 2001/3443; F01L 2001/34433; F01L 2001/3445; F01L 2001/34469; F01L 1/3442; F01L 1/344
USPC ..... 123/90.15–90.17
See application file for complete search history.

(56) References Cited

U.S. PATENT DOCUMENTS

| | | | | |
|---|---|---|---|---|
| 7,000,580 | B1 | 2/2006 | Smith et al. | |
| 8,534,246 | B2 | 9/2013 | Lichti et al. | |
| 2002/0134444 | A1* | 9/2002 | Isobe | F16K 27/041 137/625.65 |
| 2005/0061289 | A1 | 3/2005 | Plenzler et al. | |
| 2008/0135004 | A1 | 6/2008 | Simpson et al. | |
| 2015/0090207 | A1* | 4/2015 | Lichti | F01L 1/344 123/90.17 |
| 2015/0260060 | A1* | 9/2015 | Fischer | F01L 1/3442 123/90.15 |
| 2016/0010515 | A1* | 1/2016 | Snyder | F01L 1/3442 123/90.15 |
| 2016/0024978 | A1* | 1/2016 | Lichti | F01L 1/3442 123/90.15 |
| 2016/0123195 | A1* | 5/2016 | Lichti | F04C 2/3448 123/90.12 |

(Continued)

*Primary Examiner* — Patrick Hamo
*Assistant Examiner* — Kelsey L Stanley
(74) *Attorney, Agent, or Firm* — Joshua M. Haines

(57) ABSTRACT

A camshaft phaser includes a stator having a plurality of lobes; a rotor coaxially disposed within the stator, the rotor having a plurality of vanes interspersed with the plurality of lobes defining a plurality of advance chambers and a plurality of retard chambers such that the plurality of advance chambers and the plurality of retard chambers are arranged in an alternating pattern and such that the rotor rotates within the stator from a full advance position to a full retard position; and a supply passage in continuous fluid communication with one of the plurality of advance chambers, the supply passage being in continuous fluid communication with an oil source.

17 Claims, 16 Drawing Sheets

(56) References Cited

U.S. PATENT DOCUMENTS

2016/0130989 A1* 5/2016 Fischer ..... F01L 1/3442
123/90.15
2016/0169060 A1* 6/2016 Fischer ..... F01L 1/047
123/90.17

* cited by examiner

HYDRAULICALLY BIASED CAMSHAFT PHASER

CROSS-REFERENCE TO RELATED PATENT APPLICATIONS

This patent application claims the benefit of U.S. provisional patent application Ser. No. 62/380,662, filed on Aug. 29, 2016, the disclosure of which is hereby incorporated by reference in its entirety.

TECHNICAL FIELD OF INVENTION

The present invention relates to a camshaft phaser for varying the phase relationship between a crankshaft and a camshaft in an internal combustion engine; more particularly to such a camshaft phaser which is a vane-type camshaft phaser; even more particularly to a vane-type camshaft phaser which uses torque reversals of the camshaft to actuate the camshaft phaser, and still even more particularly to such a camshaft phaser which uses pressurized oil to bias a rotor of the camshaft phaser in one direction of rotation.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers by a phasing oil control valve in order to rotate the rotor within the stator and thereby change the phase relationship between the camshaft and the crankshaft. One such camshaft phaser is described in U.S. Pat. No. 8,534,246 to Lichti et al., the disclosure of which is incorporated herein by reference in its entirety and hereinafter referred to as Lichti et al.

While the camshaft phaser of Lichti et al. may be effective, the camshaft phaser may be parasitic on the lubrication system of the internal combustion engine which also supplies the oil for rotating the rotor relative to the stator, thereby requiring increased capacity of an oil pump of the internal combustion engine which adds load to the internal combustion engine. In an effort to reduce the parasitic nature of camshaft phasers, so-called cam torque actuated camshaft phasers have also been developed. In a cam torque actuated camshaft phaser, oil is moved directly from the advance chambers to the retard chambers or directly from the retard chambers to the advance chambers based on torque reversals imparted on the camshaft from intake and exhaust valves of the internal combustion engine. The torque reversals are predictable and cyclical in nature and alternate from tending to urge the rotor in the advance direction to tending to urge the rotor in the retard direction. The effects of the torque reversals on oil flow are known to be controlled by a valve spool positioned by a solenoid actuator. Accordingly, in order to advance the camshaft phaser, the valve spool is positioned by the solenoid actuator to create a passage with a first check valve therein which allows torque reversals to transfer oil from the advance chambers to the retard chambers while preventing torque reversals from transferring oil from the retard chambers to the advance chambers. Conversely, in order to retard the camshaft phaser, the valve spool is positioned by the solenoid actuator to create a passage with a second check valve therein which allows torque reversals to transfer oil from the retard chambers to the advance chambers while preventing torque reversals from transferring oil from the advance chambers to the retard chambers. One such camshaft phaser is described in U.S. Pat. No. 7,000,580 to Smith et al. Other examples of torque actuated camshaft phasers are known to utilize a single check valve to control the torque reversals of the camshaft in order to achieve the desired direction of phase change of the camshaft.

The torque reversals which actuate cam torque actuated camshaft phasers are not symmetric between causing a retard in timing of the camshaft and causing an advance in the timing of the camshaft. More specifically, the torque reversals tend to produce a greater retarding effect than an advancing effect, thereby causing a slower rate of advancing the timing of the camshaft compared to the rate of retarding the timing of the camshaft. Furthermore, cold temperatures and slow engine speeds can exacerbate the low rate of advancing the timing of the camshaft, and may prove unsatisfactory in advancing the timing of the camshaft in some situations.

What is needed is camshaft phaser which minimizes or eliminates one or more the shortcomings as set forth above.

SUMMARY OF THE INVENTION

Briefly described, a camshaft phaser is provided for use with an internal combustion engine for controllably varying the phase relationship between a crankshaft and a camshaft in the internal combustion engine. The camshaft phaser includes a stator having a plurality of lobes, the stator being connectable to the crankshaft of the internal combustion engine to provide a fixed ratio of rotation between the stator and the crankshaft; a rotor coaxially disposed within the stator, the rotor having a plurality of vanes interspersed with the plurality of lobes defining a plurality of advance chambers and a plurality of retard chambers such that the plurality of advance chambers and the plurality of retard chambers are arranged in an alternating pattern and such that the rotor rotates within the stator from a full advance position to a full retard position; and a supply passage in continuous fluid communication with one of the plurality of advance chambers, the supply passage being in continuous fluid communication with an oil source.

A method of using a camshaft phaser is also provided where the camshaft phaser is used with an internal combustion engine for controllably varying the phase relationship between a crankshaft and a camshaft in the internal combustion engine, and where the camshaft phaser includes a stator having a plurality of lobes, the stator being connectable to the crankshaft of the internal combustion engine to provide a fixed ratio of rotation between the stator and the crankshaft; a rotor coaxially disposed within the stator, the rotor having a plurality of vanes interspersed with the plurality of lobes defining a plurality of advance chambers and a plurality of retard chambers such that the plurality of advance chambers and the plurality of retard chambers are arranged in an alternating pattern and such that the rotor rotates within the stator from a full advance position to a full retard position; and a supply passage. The method comprises using the supply passage to provide continuous fluid communication between one of the plurality of advance chambers and an oil source.

BRIEF DESCRIPTION OF DRAWINGS

This invention will be further described with reference to the accompanying drawings in which.

DETAILED DESCRIPTION OF INVENTION

Figure 1:
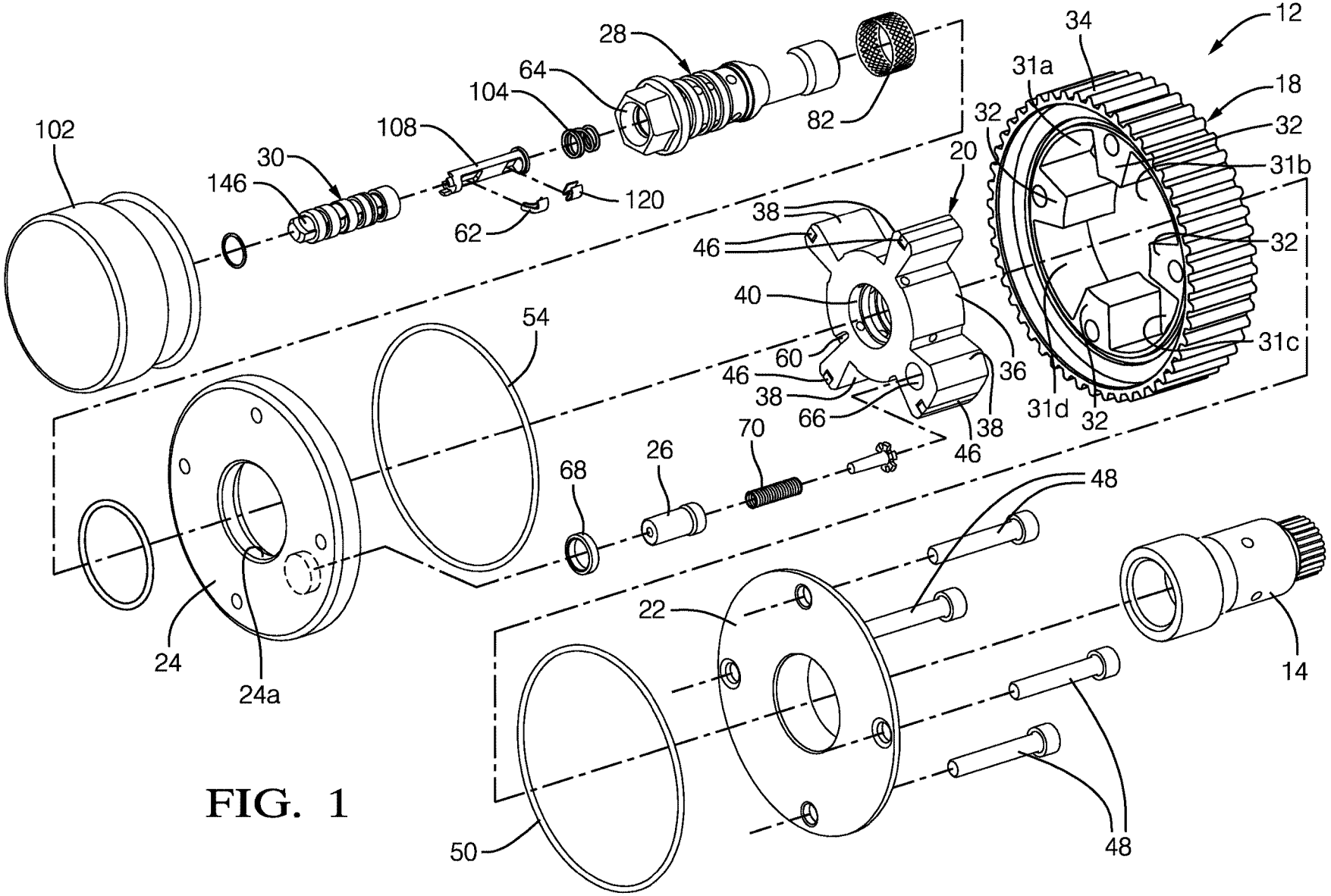
FIG. 1 is an exploded isometric view of a camshaft phaser in accordance with the present invention.

In accordance with a preferred embodiment of this invention and referring to FIGS. 1-4, an internal combustion engine 10 is shown which includes a camshaft phaser 12. Internal combustion engine 10 also includes a camshaft 14 which is rotatable about a camshaft axis 16 based on rotational input from a crankshaft and belt (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18 which acts and an input member, a rotor 20 disposed coaxially within stator 18 which acts as an output member, a back cover 22 closing off one end of stator 18, a front cover 24 closing off the other end of stator 18, a lock pin 26, a camshaft phaser attachment bolt 28 for attaching camshaft phaser 12 to camshaft 14, and a valve spool 30. The various elements of camshaft phaser 12 will be described in greater detail in the paragraphs that follow.

Stator 18 is generally cylindrical and includes a plurality of radial chambers 31*a*, 31*b*, 31*c*, and 31*d* defined by a plurality of lobes 32 extending radially inward. In the embodiment shown, there are four lobes 32 defining four radial chambers 31*a*, 31*b*, 31*c*, 31*d*, however, it is to be understood that a different number of lobes 32 may be provided to define radial chambers 31*a*, 31*b*, 31*c*, 31*d*, equal in quantity to the number of lobes 32. Stator 18 may also include a toothed pulley 34 formed integrally therewith or otherwise fixed thereto. Pulley 34 is configured to be driven by a belt that is driven by the crankshaft of internal combustion engine 10. Alternatively, pulley 34 may be a sprocket driven by a chain or other any other known drive member known for driving camshaft phaser 12 by the crankshaft.

Rotor 20 includes a central hub 36 with a plurality of vanes 38 extending radially outward therefrom and a rotor central through bore 40 extending axially therethrough. The number of vanes 38 is equal to the number of radial chambers 31*a*, 31*b*, 31*c*, 31*d* provided in stator 18. Rotor 20 is coaxially disposed within stator 18 such that each vane 38 divides radial chambers 31*a*, 31*b*, 31*c*, 31*d* into advance chambers 42*a*, 42*b*, 42*c*, 42*d* and retard chambers 44*a*, 44*b*, 44*c*, and 44*d* respectively. The radial tips of lobes 32 are mateable with central hub 36 in order to separate radial chambers 31 from each other. Each of the radial tips of vanes 38 may include one of a plurality of wiper seals 46 to substantially seal adjacent advance chambers 42*a*, 42*b*, 42*c*, 42*d* and retard chambers 44*a*, 44*b*, 44*c*, 44*d* from each other. While not shown, each of the radial tips of lobes 32 may also include one of a plurality of wiper seals 46.

Back cover 22 is sealingly secured, using cover bolts 48, to the axial end of stator 18 that is proximal to camshaft 14. Tightening of cover bolts 48 prevents relative rotation between back cover 22 and stator 18. A back cover seal 50, for example only, an O-ring, may be provided between back cover 22 and stator 18 in order to provide an oil-tight seal between the interface of back cover 22 and stator 18. Back cover 22 includes a back cover central bore 52 extending coaxially therethrough. The end of camshaft 14 is received coaxially within back cover central bore 52 such that camshaft 14 is allowed to rotate relative to back cover 22. In an alternative arrangement, pulley 34 may be integrally formed or otherwise attached to back cover 22 rather than stator 18.

Similarly, front cover 24 is sealingly secured, using cover bolts 48, to the axial end of stator 18 that is opposite back cover 22. Front cover 24 includes a front cover central bore 24*a* extending coaxially therethrough. A front cover seal 54, for example only, an O-ring, may be provided between front cover 24 and stator 18 in order to provide an oil-tight seal between the interface of front cover 24 and stator 18. Cover bolts 48 pass through back cover 22 and stator 18 and threadably engage front cover 24; thereby clamping stator 18 between back cover 22 and front cover 24 to prevent relative rotation between stator 18, back cover 22, and front cover 24. In this way, advance chambers 42*a*, 42*b*, 42*c*, 42*d* and retard chambers 44*a*, 44*b*, 44*c*, and 44*d* are defined axially between back cover 22 and front cover 24.

Camshaft phaser 12 is attached to camshaft 14 with camshaft phaser attachment bolt 28 which extends coaxially through rotor central through bore 40 of rotor 20 and threadably engages camshaft 14, thereby by clamping rotor 20 securely to camshaft 14. In this way, relative rotation between stator 18 and rotor 20 results in a change is phase or timing between the crankshaft of internal combustion engine 10 and camshaft 14. Access to camshaft phaser attachment bolt 28 for installation and removal is provided through front cover central bore 24*a*.

Figure 12:
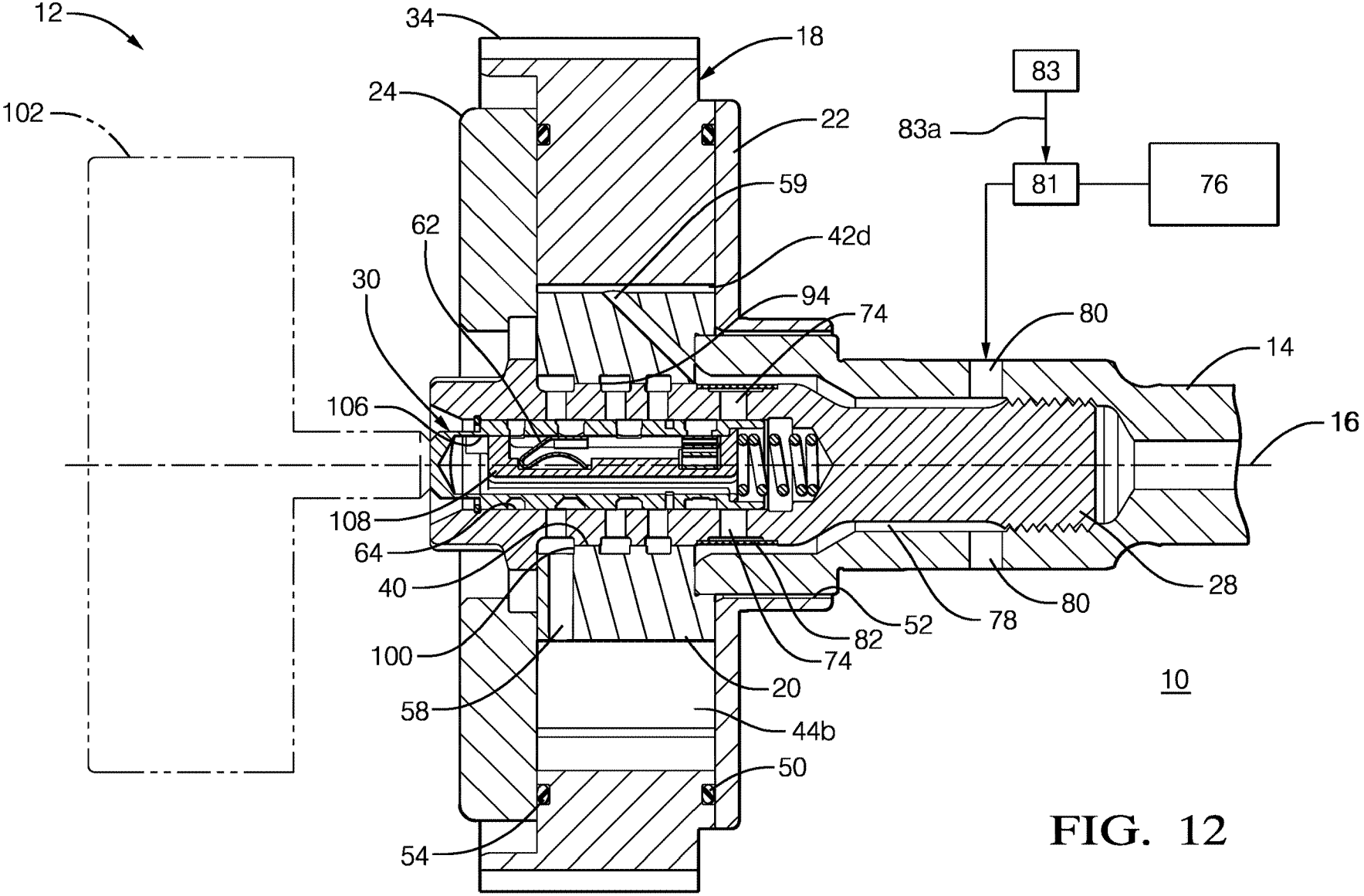
FIG. 12 is an axial cross-sectional view of the camshaft phaser showing a supply passage which provides constant communication between an oil source and an advance chamber of the camshaft phaser.
Figure 13:
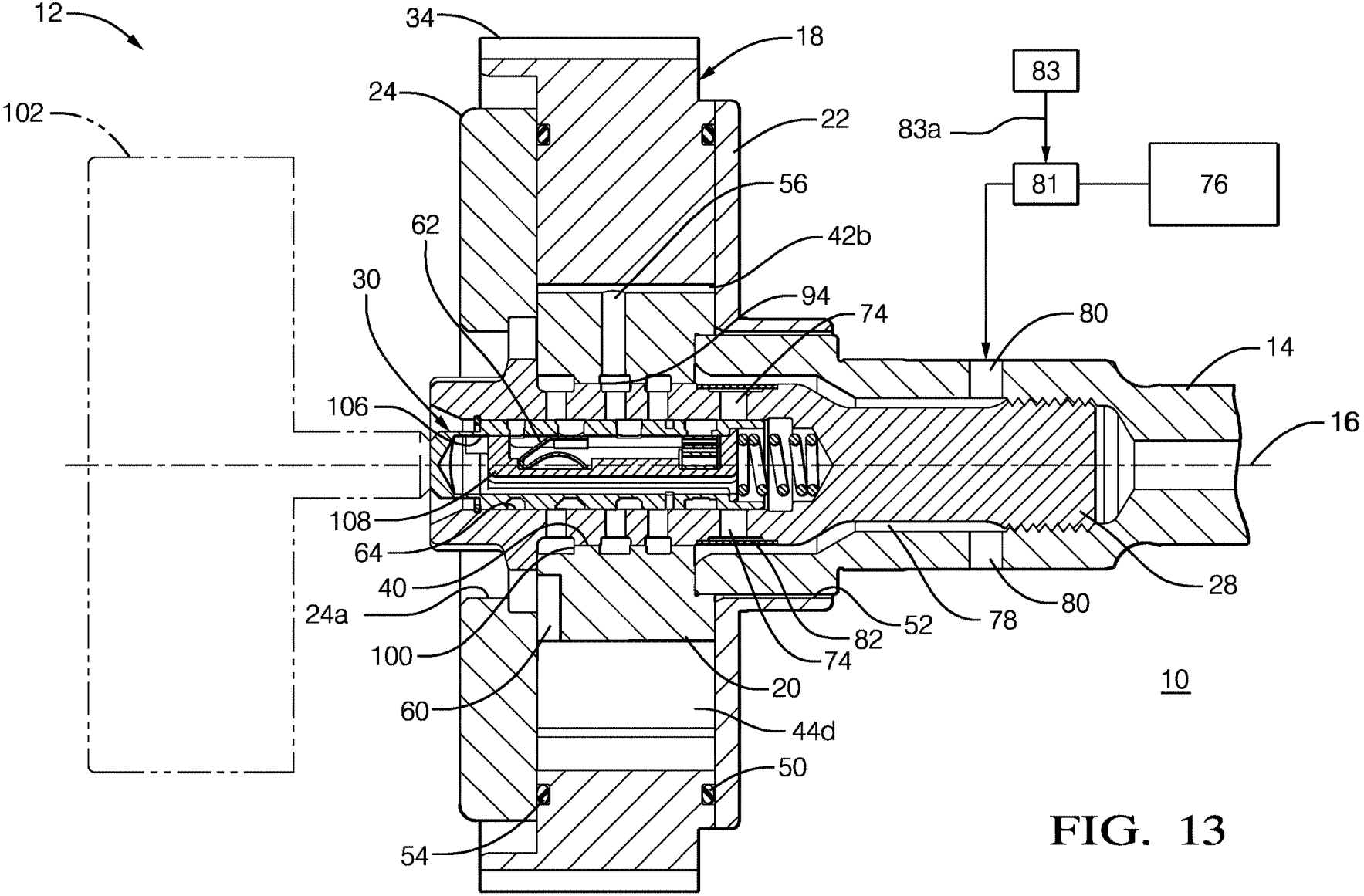
FIG. 13 is an axial cross-sectional view of the camshaft phaser showing a vent passage which continuously prevents pressurization of a retard chamber of the camshaft phaser.

Oil is selectively transferred to advance chambers 42*a*, 42*b*, 42*c* from retard chambers 44*a*, 44*b*, 44*c*, as result of torque applied to camshaft 14 from the valve train of internal combustion engine 10, i.e. torque reversals of camshaft 14, in order to cause relative rotation between stator 18 and rotor 20 which results in retarding the timing of camshaft 14 relative to the crankshaft of internal combustion engine 10. Conversely, oil is selectively transferred to retard chambers 44*a*, 44*b*, 44*c* from advance chambers 42*a*, 42*b*, 42*c*, as result of torque applied to camshaft 14 from the valve train of internal combustion engine 10, in order to cause relative rotation between stator 18 and rotor 20 which results in advancing the timing of camshaft 14 relative to the crankshaft of internal combustion engine 10. Rotor advance passages 56 may be provided in rotor 20 for supplying and venting oil to and from advance chambers 42*a*, 42*b*, 42*c* while rotor retard passages 58 may be provided in rotor 20 for supplying and venting oil to and from retard chambers 44*a*, 44*b*, 44*c*. Transferring oil to advance chambers 42*a*, 42*b*, 42*c* from retard chambers 44*a*, 44*b*, 44*c* and transferring oil to retard chambers 44*a*, 44*b*, 44*c* from advance chambers 42*a*, 42*b*, 42*c* is controlled by valve spool 30 and a phasing check valve 62, as will be described in detail later, such that valve spool 30 is coaxially disposed slidably within a valve bore 64 of camshaft phaser attachment bolt 28 where valve bore 64 is centered about camshaft axis 16. Unlike advance chambers 42*a*, 42*b*, 42*c* which selectively receive oil from and supply oil to retard chambers 44*a*, 44*b*, 44*c*, advance chamber 42*d* is in constant fluid communication with an oil source 76 through a rotor supply passage 59, which is best shown in FIG. 12, as will be described in greater detail later. It should be emphasized that advance chamber 42*d* does not receive or supply oil to or from any of retard chambers 44*a*, 44*b*, 44*c*, 44*d*. Furthermore, unlike retard chambers 44*a*, 44*b*, 44*c*, retard chamber 44*d* is continuously prevented from being pressurized by virtue of a rotor vent passage 60 provided in rotor 20, which is best shown in FIGS. 1 and 13, which vents retard chamber 44*d* to the exterior of camshaft phaser 12 as will be described in greater detail later. It should be emphasized that retard chamber 44*d* does not receive oil from or supply oil to any of advance chambers 42*a*, 42*b*, 42*c*, 42*d*.

Lock pin 26 selectively prevents relative rotation between stator 18 and rotor 20 at a predetermined aligned position of rotor 20 within stator 18, which as shown, may be a full advance position, i.e. rotor 20 as far as possible within stator 18 in the advance direction of rotation. Lock pin 26 is slidably disposed within a lock pin bore 66 formed in one vane 38 of rotor 20. A lock pin seat 68 is provided in front cover 24 for selectively receiving lock pin 26 therewithin. Lock pin 26 and lock pin seat 68 are sized to substantially prevent rotation between stator 18 and rotor 20 when lock pin 26 is received within lock pin seat 68. When lock pin 26 is not desired to be seated within lock pin seat 68, pressurized oil is supplied to lock pin bore 66 through a rotor lock pin passage 72 formed in rotor 20, thereby urging lock pin 26 out of lock pin seat 68 and compressing a lock pin spring 70. Conversely, when lock pin 26 is desired to be seated within lock pin seat 68, the pressurized oil is vented from lock pin bore 66 through rotor lock pin passage 72, thereby allowing lock pin spring 70 to urge lock pin 26 toward front cover 24. In this way, lock pin 26 is seated within lock pin seat 68 by lock pin spring 70 when rotor 20 is positioned within stator 18 to allow alignment of lock pin 26 with lock pin seat 68. Supplying and venting of pressurized oil to and from lock pin 26 is controlled by valve spool 30 as will be described later.

Camshaft phaser attachment bolt 28 and valve spool 30, which act together to function as a valve, will now be described in greater detail with continued reference to FIGS. 1-4 and now with additional reference to FIGS. 5A-11. Camshaft phaser attachment bolt 28 includes bolt supply passages 74 which extend radially outward from valve bore 64 to the outside surface of camshaft phaser attachment bolt 28. Bolt supply passages 74 receive pressurized oil from oil source 76, for example, an oil pump of internal combustion engine 10, via an annular oil supply passage 78 formed radially between camshaft phaser attachment bolt 28 and a counter bore of camshaft 14 and also via radial camshaft oil passages 80 of camshaft 14. A pressure regulating valve 81 may be provided such that an inlet of pressure regulating valve 81 receives pressurized oil from oil source 76 and an outlet of pressure regulating valve 81 communicates oil to radial camshaft oil passage 80 that is less than or equal to a predetermined value. Preferably, pressure regulating valve 81 is adaptive to provide a variable pressure to radial camshaft oil passage 80, for example by command from a controller 83 which is in electrical communication with pressure regulating valve 81 and which sends a control signal 83*a*, for example pulse width modulation, to pressure regulating valve 81. Control signal 83*a* may be varied to achieve different pressures at the outlet of pressure regulating valve 81 in order to take into account operating conditions of internal combustion engine 10, by way of non-limiting example only, temperature of the oil or rotational speed of internal combustion engine 10. By way of non-limiting example only, oil source 76 may be providing oil at a pressure of X psi, however, pressure regulating valve 81 may be commanded by controller 83 to output a pressure of Y psi which is less than X psi. In this way, pressure regulating valve 81 reduces the pressure of oil that is supplied to camshaft radial oil passage 80. It should be noted that pressure regulating valve 81 may be designed to ensure communication from oil source 76 to radial camshaft oil passage 80 is always possible, regardless of control signal 83*a* or even if control signal 83*a* is not present due to malfunction. The pressurized oil from oil source 76 is used to 1) replenish oil that may leak from advance chambers 42*a*, 42*b*, 42*c* and retard chambers 44*a*, 44*b*, 44*c* in use, 2) to disengage lock pin 26 from lock pin seat 68, and 3) to replenish oil that is vented from lock pin 26. A filter 82 may circumferentially surround camshaft phaser attachment bolt 28 at bolt supply passages 74 in order to prevent foreign matter that may be present in the oil from reaching valve spool 30.

Camshaft phaser attachment bolt 28 also includes a bolt annular lock pin groove 84 on the outer periphery of camshaft phaser attachment bolt 28 and bolt lock pin passages 86 extend radially outward from valve bore 64 to bolt annular lock pin groove 84. Bolt annular lock pin groove 84 is spaced axially apart from bolt supply passages 74 in a direction away from camshaft 14 and is aligned with a rotor annular lock pin groove 88 which extends radially outward from rotor central through bore 40 such that rotor lock pin passage 72 extends from rotor annular lock pin groove 88 to lock pin bore 66. In this way, fluid communication is provided between valve bore 64 and lock pin bore 66.

Camshaft phaser attachment bolt 28 also includes a bolt annular advance groove 90 on the outer periphery of camshaft phaser attachment bolt 28 and bolt advance passages 92 extend radially outward from valve bore 64 to bolt annular advance groove 90. Bolt annular advance groove 90 is spaced axially apart from bolt supply passages 74 and bolt annular lock pin groove 84 such that bolt annular lock pin groove 84 is axially between bolt supply passages 74 and bolt annular advance groove 90. Bolt annular advance groove 90 is aligned with a rotor annular advance groove 94 which extends radially outward from rotor central through bore 40 such that rotor advance passages 56 extend from rotor annular advance groove 94 to advance chambers 42*a*, 42*b*, 42*c*. In this way, fluid communication is provided between valve bore 64 and advance chambers 42*a*, 42*b*, 42*c*. However, it should be emphasized that bolt annular advance groove 90 and rotor annular advance groove 94 are not in fluid communication with advance chamber 42*d*.

Camshaft phaser attachment bolt 28 also includes a bolt annular retard groove 96 on the outer periphery of camshaft phaser attachment bolt 28 and bolt retard passages 98 extend radially outward from valve bore 64 to bolt annular retard groove 96. Bolt annular retard groove 96 is spaced axially apart from bolt annular advance groove 90 such that bolt annular advance groove 90 is axially between bolt annular lock pin groove 84 and bolt annular retard groove 96. Bolt annular retard groove 96 and is aligned with a rotor annular retard groove 100 which extends radially outward from rotor central through bore 40 such that rotor retard passages 58 extend from rotor annular retard groove 100 to retard chambers 44*a*, 44*b*, 44*c*. In this way, fluid communication is provided between valve bore 64 and retard chambers 44*a*, 44*b*, 44*c*. However, it should be emphasized that bolt annular retard groove 96 and rotor annular retard groove 100 are not in fluid communication with retard chamber 44*d*.

Valve spool 30 is moved axially within valve bore 64 of camshaft phaser attachment bolt 28 by an actuator 102 and a valve spring 104 to achieve desired operational states of camshaft phaser 12 by opening and closing bolt supply passages 74, bolt lock pin passages 86, bolt advance passages 92, and bolt retard passages 98 as will now be described. Valve spool 30 includes a valve spool bore 106 extending axially thereinto from the end of valve spool 30 that is proximal to camshaft 14. An insert 108 is disposed within valve spool bore 106 such that insert 108 defines a phasing volume 110 and a venting volume 112 such that phasing volume 110 is substantially fluidly segregated from venting volume 112, i.e. phasing volume 110 does not communicate with venting volume 112. Phasing check valve 62 is captured between insert 108 and valve spool bore 106 such that phasing check valve 62 is grounded to insert 108. By way of non-limiting example only, insert 108 may be net-formed by plastic injection molding and may be easily inserted within valve spool bore 106 from the end of valve spool bore 106 that is proximal to valve spring 104 prior to valve spool 30 being inserted into valve bore 64 of camshaft phaser attachment bolt 28. In this way, phasing volume 110 and venting volume 112 are easily and economically formed.

Valve spool 30 also includes a supply land 114 which is sized to fit within valve bore 64 in a close sliding relationship such that oil is substantially prevented from passing between the interface between supply land 114 and valve bore 64 while allowing valve spool 30 to be displaced axially within valve bore 64 substantially uninhibited.

Valve spool 30 also includes a spool annular supply groove 116 that is axially adjacent to supply land 114. A spool supply passage 118 extends radially inward from spool annular supply groove 116 to phasing volume 110 within valve spool bore 106. A supply check valve 120 is captured between insert 108 and valve spool bore 106 within phasing volume 110 such that phasing check valve 62 is grounded to insert 108 in order to allow oil to enter phasing volume 110 from spool supply passage 118 while substantially preventing oil from exiting phasing volume 110 to spool supply passage 118.

Valve spool 30 also includes a lock pin land 122 that is axially adjacent to spool annular supply groove 116. Lock pin land 122 is sized to fit within valve bore 64 in a close sliding relationship such that oil is substantially prevented from passing between the interface between lock pin land 122 and valve bore 64 while allowing valve spool 30 to be displaced axially within valve bore 64 substantially uninhibited. Lock pin land 122 is axially divided by a spool annular lock pin groove 124 such that a spool lock pin passage 126 extends radially inward from spool annular lock pin groove 124 to venting volume 112 within valve spool bore 106, thereby providing fluid communication between spool annular lock pin groove 124 and venting volume 112.

Valve spool 30 also includes a spool annular advance groove 128 that is axially adjacent to lock pin land 122. A spool advance passage 130 extends radially inward from spool annular advance groove 128 to phasing volume 110 within valve spool bore 106 in order to provide fluid communication between spool annular advance groove 128 and phasing volume 110.

Valve spool 30 also includes an advance land 131 that is axially adjacent to spool annular advance groove 128. Advance land 131 is sized to fit within valve bore 64 in a close sliding relationship such that oil is substantially prevented from passing between the interface between advance land 131 and valve bore 64 while allowing valve spool 30 to be displaced axially within valve bore 64 substantially uninhibited.

Valve spool 30 also includes a spool annular recirculation groove 132 that is axially adjacent to advance land 131. A spool recirculation passage 134 extends radially inward from spool annular recirculation groove 132 to phasing volume 110 within valve spool bore 106. Phasing check valve 62 is located in phasing volume 110 in order to allow oil to enter phasing volume 110 from spool recirculation passage 134 while substantially preventing oil from exiting phasing volume 110 to spool recirculation passage 134.

Valve spool 30 also includes a retard land 138 that is axially adjacent to spool annular recirculation groove 132. Retard land 138 is sized to fit within valve bore 64 in a close sliding relationship such that oil is substantially prevented from passing between the interface between retard land 138 and valve bore 64 while allowing valve spool 30 to be displaced axially within valve bore 64 substantially uninhibited.

Valve spool 30 also includes a spool annular retard groove 140 that is axially adjacent to retard land 138. A spool retard passage 142 extends radially inward from spool annular retard groove 140 to phasing volume 110 within valve spool bore 106 in order to provide fluid communication between spool annular retard groove 140 and phasing volume 110.

Valve spool 30 also includes an end land 144 that is axially adjacent to spool annular retard groove 140. End land 144 is sized to fit within valve bore 64 in a close sliding relationship such that oil is substantially prevented from passing between the interface between end land 144 and valve bore 64 while allowing valve spool 30 to be displaced axially within valve bore 64 substantially uninhibited.

Valve spool 30 also includes vent passages 146 which extend radially outward from venting volume 112, thereby allowing oil within venting volume 112 to be vented to valve bore 64 and out of camshaft phaser 12 where it may be drained back to oil source 76. Alternatively, a passage could be formed in camshaft phaser attachment bolt 28 which extends from valve bore 64 to a drain passage in camshaft 14 in order to vent oil within venting volume 112 where it may be drained back to oil source 76.

Figure 5A:
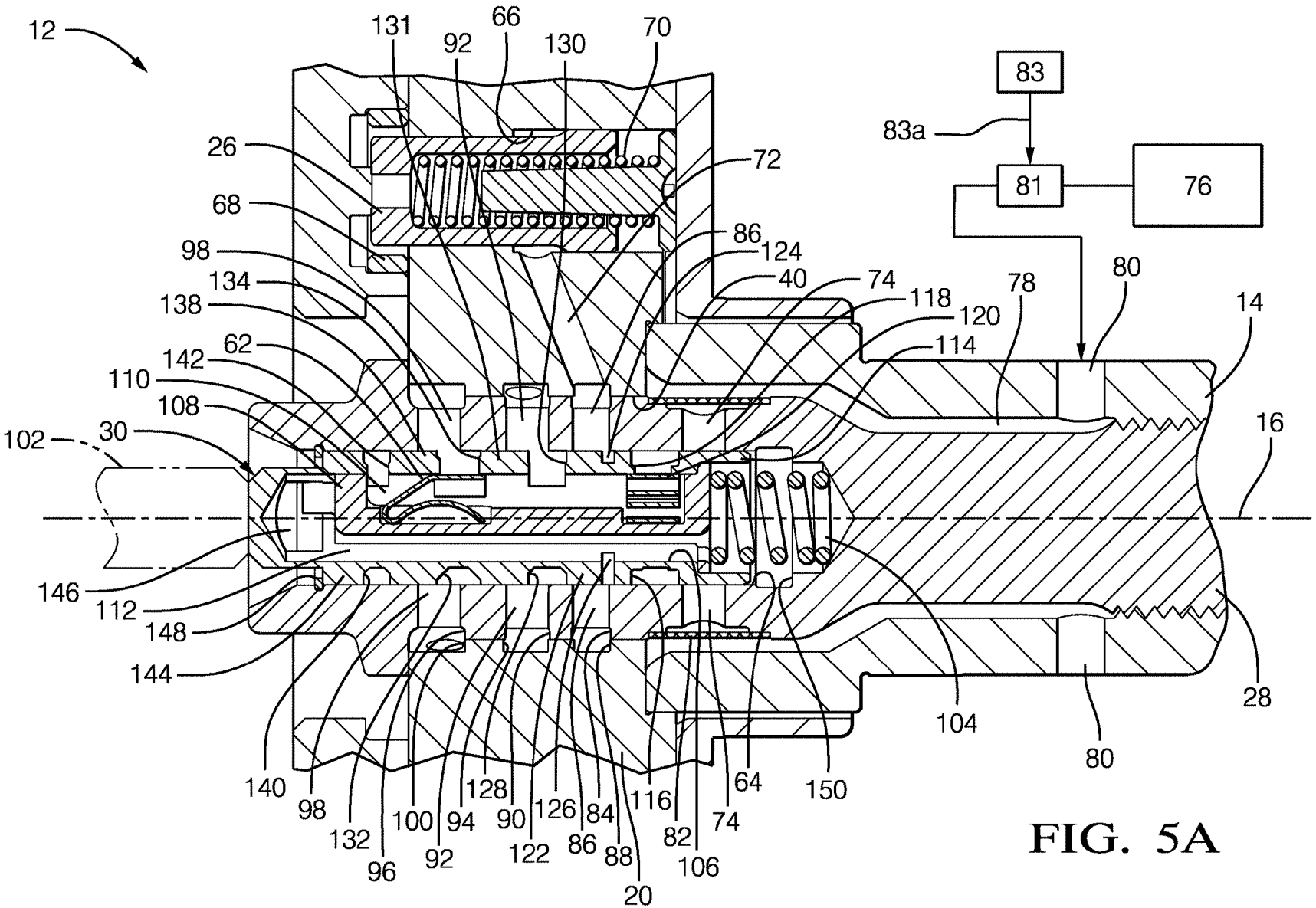
FIG. 5A is an enlarged portion of FIG. 4 showing a valve spool of the camshaft phaser in a default position with a lock pin engaged with a lock pin seat.
Figure 5B:
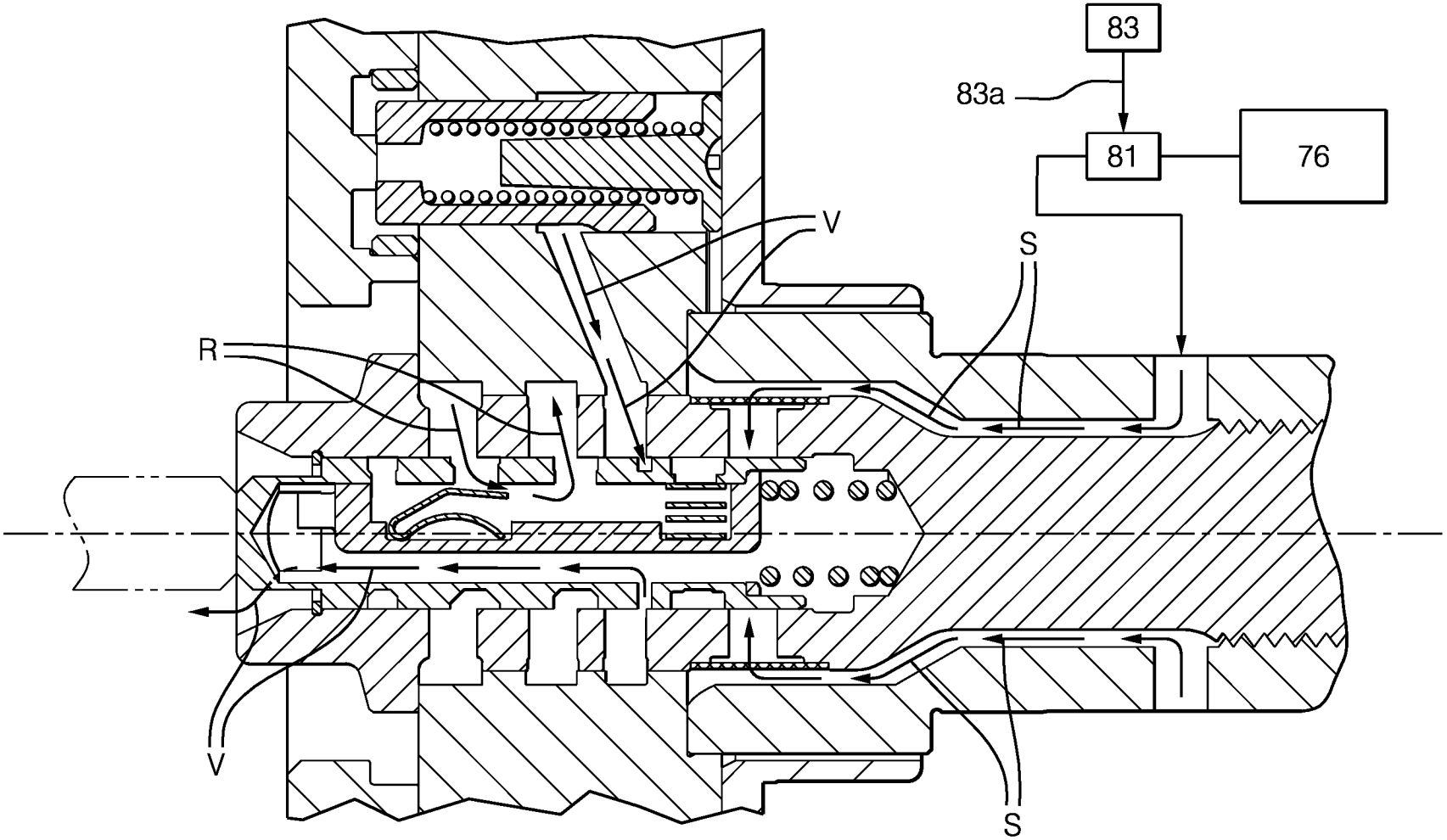
FIG. 5B is the view of FIG. 5A shown with reference numbers removed in order to clearly shown the path of travel of oil.

Actuator 102 may be a solenoid actuator that is selectively energized with an electric current of varying magnitude in order to position valve spool 30 within valve bore 64 at desired axial positions, thereby controlling oil flow to achieve desired operation of camshaft phaser 12. In a default position, when no electric current is supplied to actuator 102 as shown in FIGS. 5A and 5B, valve spring 104 urges valve spool 30 in a direction toward actuator 102 until valve spool 30 axially abuts a first stop member 148, which may be, by way of non-limiting example only, a snap ring within a snap ring groove extending radially outward from valve bore 64. In the default position, supply land 114 is positioned to block bolt supply passages 74, thereby preventing pressurized oil from being supplied to phasing volume 110 from oil source 76. Also in the default position, lock pin land 122 is positioned to align spool annular lock pin groove 124 with bolt lock pin passages 86, thereby allowing oil to be vented from lock pin bore 66 via rotor lock pin passage 72, rotor annular lock pin groove 88, bolt lock pin passages 86, spool annular lock pin groove 124, spool lock pin passage 126, venting volume 112, and vent passages 146 and consequently allowing lock pin spring 70 to urge lock pin 26 toward front cover 24. In the default position, lock pin land 122 also blocks fluid communication between bolt lock pin passages 86 and phasing volume 110. Also in the default position, advance land 131 is positioned to permit fluid communication between bolt advance passages 92 and phasing volume 110 via spool annular advance groove 128 and spool advance passage 130 while retard land 138 is positioned to permit fluid communication between bolt retard passages 98 and phasing volume 110 via spool annular recirculation groove 132, spool recirculation passage 134, and phasing check valve 62. However, fluid communication is prevented from bolt advance passages 92 directly to spool annular recirculation groove 132 and fluid communication is prevented from bolt retard passages 98 directly to spool annular retard groove 140. In this way, torque reversals of camshaft 14 that tend to pressurize oil within retard chambers 44*a*, 44*b*, 44*c* cause oil to be vented out of retard chambers 44*a*, 44*b*, 44*c* and to be supplied to advance chambers 42*a*, 42*b*, 42*c* via rotor retard passages 58, rotor annular retard groove 100, bolt annular retard groove 96, bolt retard passages 98, spool annular recirculation groove 132, spool recirculation passage 134, phasing check valve 62, phasing volume 110, spool advance passage 130, spool annular advance groove 128, bolt advance passages 92, bolt annular advance groove 90, rotor annular advance groove 94, and rotor advance passages 56. However, torque reversals of camshaft 14 that tend to pressurize oil within advance chambers 42*a*, 42*b*, 42*c* are prevented from venting oil from advance chambers 42*a*, 42*b*, 42*c* because phasing check valve 62 prevents oil from being supplied to retard chambers 44*a*, 44*b*, 44*c*. Consequently, in the default position, torque reversals of camshaft 14 cause rotor 20 to rotate relative to stator 18 to cause an advance in timing of camshaft 14 relative to the crankshaft, and when lock pin 26 is aligned with lock pin seat 68, lock pin spring 70 urges lock pin 26 into lock pin seat 68 to retain rotor 20 in the predetermined aligned position with stator 18. It should be emphasized that since oil source 76 is in constant fluid communication with advance chamber 42*d* through rotor supply passage 59, additional assistance in moving rotor 20 in the advance direction is provided by pressurized oil acting on advance chamber 42*d*. In FIG. 5B, the reference numbers have been removed for clarity and arrows representing the path of travel of the oil have been included where arrows S represent oil from oil source 76, arrows V represent vented oil from lock pin bore 66, and arrows R represent oil that is being recirculated for rotating rotor 20 relative to stator 18. It should be noted that FIG. 5B shows phasing check valve 62 being opened, but phasing check valve 62 may also be closed depending on the direction of the torque reversion of camshaft 14 at a particular time.

Figure 6A:
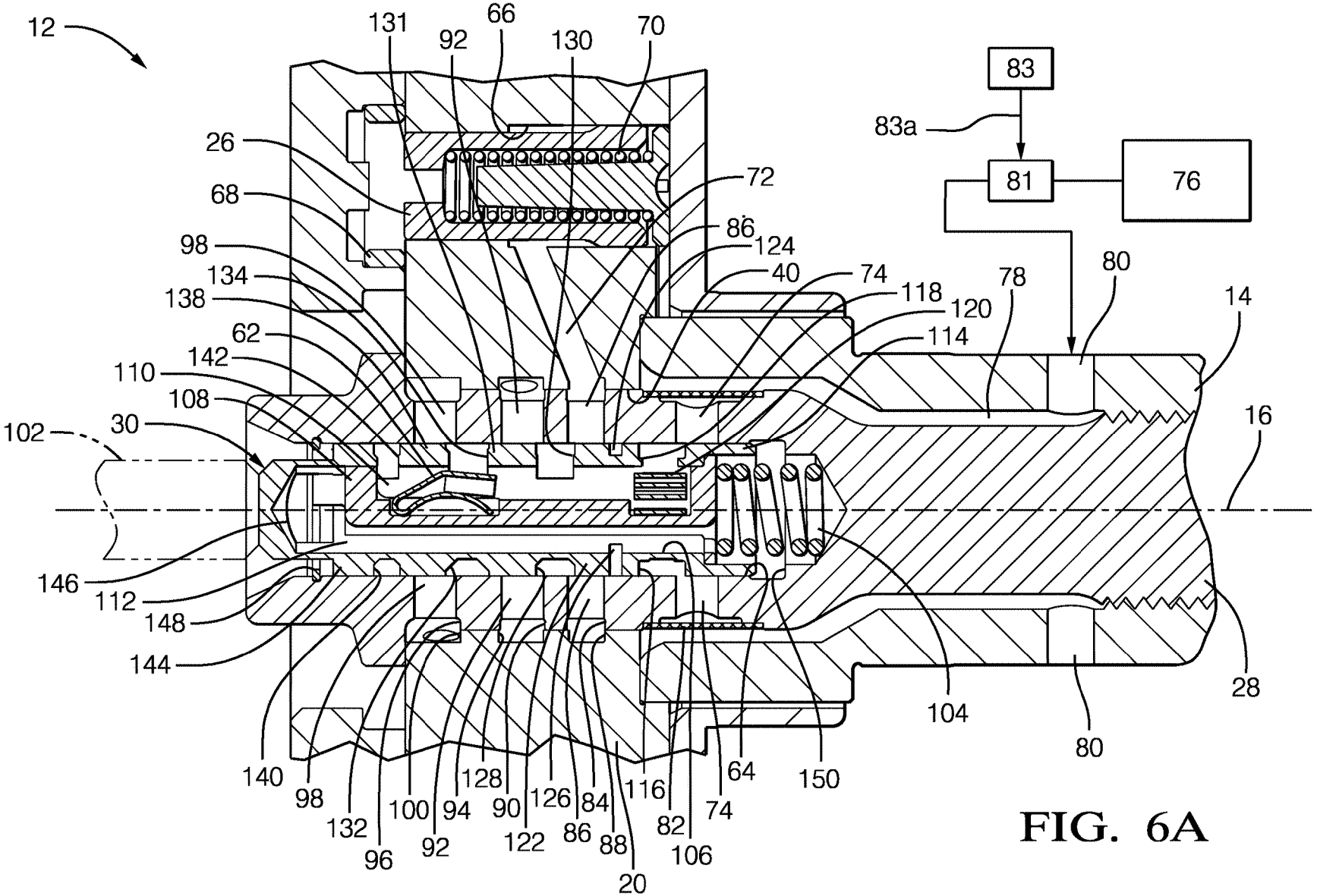
FIG. 6A is the view of FIG. 5A now shown with the valve spool in an advance position now with the lock pin retracted from the lock pin seat.
Figure 6B:
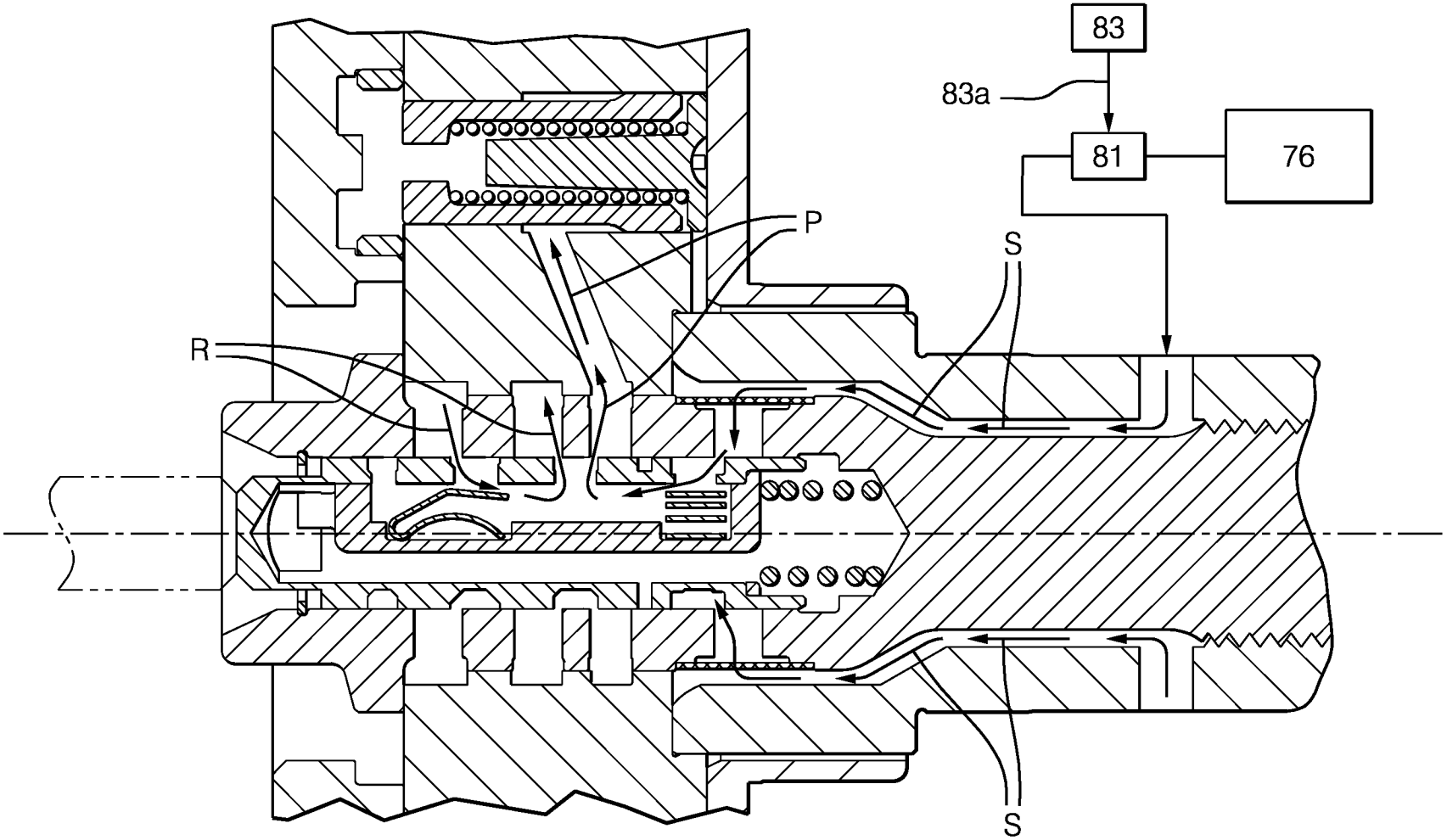
FIG. 6B is the view of FIG. 6A shown with reference numbers removed and arrows added in order to clearly shown the path of travel of oil.

In an advance position, when an electric current of a first magnitude is supplied to actuator 102 as shown in FIGS. 6A and 6B, actuator 102 urges valve spool 30 in a direction toward valve spring 104 thereby causing valve spring 104 to be compressed slightly. In the advance position, supply land 114 is positioned to open bolt supply passages 74, thereby allowing pressurized oil to be supplied to phasing volume 110 through supply check valve 120 from oil source 76 when pressure within phasing volume 110 is lower than the pressure of oil source 76. Also in the advance position, lock pin land 122 is positioned to prevent fluid communication between bolt lock pin passages 86 and spool annular lock pin groove 124, thereby preventing oil from being vented from lock pin bore 66. In the advance position, lock pin land 122 also opens fluid communication between bolt lock pin passages 86 and phasing volume 110, thereby allowing pressurized oil to be supplied to lock pin bore 66 via spool advance passage 130, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. It should be noted that by supplying oil to lock pin bore 66 from phasing volume 110, a separate dedicated supply for retracting lock pin 26 from lock pin seat 68 is not required. Also in the advance position, advance land 131 is positioned to permit fluid communication between bolt advance passages 92 and phasing volume 110 via spool annular advance groove 128 and spool advance passage 130 while retard land 138 is positioned to permit fluid communication between bolt retard passages 98 and phasing volume 110 via spool annular recirculation groove 132, spool recirculation passage 134, and phasing check valve 62. However, fluid communication is prevented from bolt advance passages 92 directly to spool annular recirculation groove 132 and fluid communication is prevented from bolt retard passages 98 directly to spool annular retard groove 140. In this way, torque reversals of camshaft 14 that tend to pressurize oil within retard chambers 44*a*, 44*b*, 44*c* cause oil to be vented out of retard chambers 44*a*, 44*b*, 44*c* and to be supplied to advance chambers 42*a*, 42*b*, 42*c* via rotor retard passages 58, rotor annular retard groove 100, bolt annular retard groove 96, bolt retard passages 98, spool annular recirculation groove 132, spool recirculation passage 134, phasing check valve 62, phasing volume 110, spool advance passage 130, spool annular advance groove 128, bolt advance passages 92, bolt annular advance groove 90, rotor annular advance groove 94, and rotor advance passages 56. However, torque reversals of camshaft 14 that tend to pressurize oil within advance chambers 42*a*, 42*b*, 42*c* are prevented from venting oil from advance chambers 42*a*, 42*b*, 42*c* because phasing check valve 62 prevents oil from being supplied to retard chambers 44*a*, 44*b*, 44*c*. Consequently, in the advance position, torque reversals of camshaft 14 cause rotor 20 to rotate relative to stator 18 to cause an advance in timing of camshaft 14 relative to the crankshaft. It should be noted that supply check valve 120 prevents oil from being communicated to oil source 76 from phasing volume 110 when torque reversals of camshaft 14 produce oil pressures that are greater than the pressure produced by oil source 76. It should be emphasized that since oil source 76 is in constant fluid communication with advance chamber 42*d*, additional assistance in moving rotor 20 in the advance direction is provided by pressurized oil acting on advance chamber 42*d*. In FIG. 6B, the reference numbers have been removed for clarity and arrows representing the path of travel of the oil have been included where arrows S represent oil from oil source 76, arrows R represent oil that is being recirculated for rotating rotor 20 relative to stator 18, and arrows P represent oil that is pressurized to retract lock pin 26 from lock pin seat 68. It should be noted that FIG. 6B shows phasing check valve 62 being opened, but phasing check valve 62 may also be closed depending on the direction of the torque reversion of camshaft 14 at a particular time. It should also be noted that supply check valve 120 is shown open in FIG. 6B, but may typically remain closed unless lock pin 26 is in the process of being retracted from lock pin seat 68.

Figure 7A:
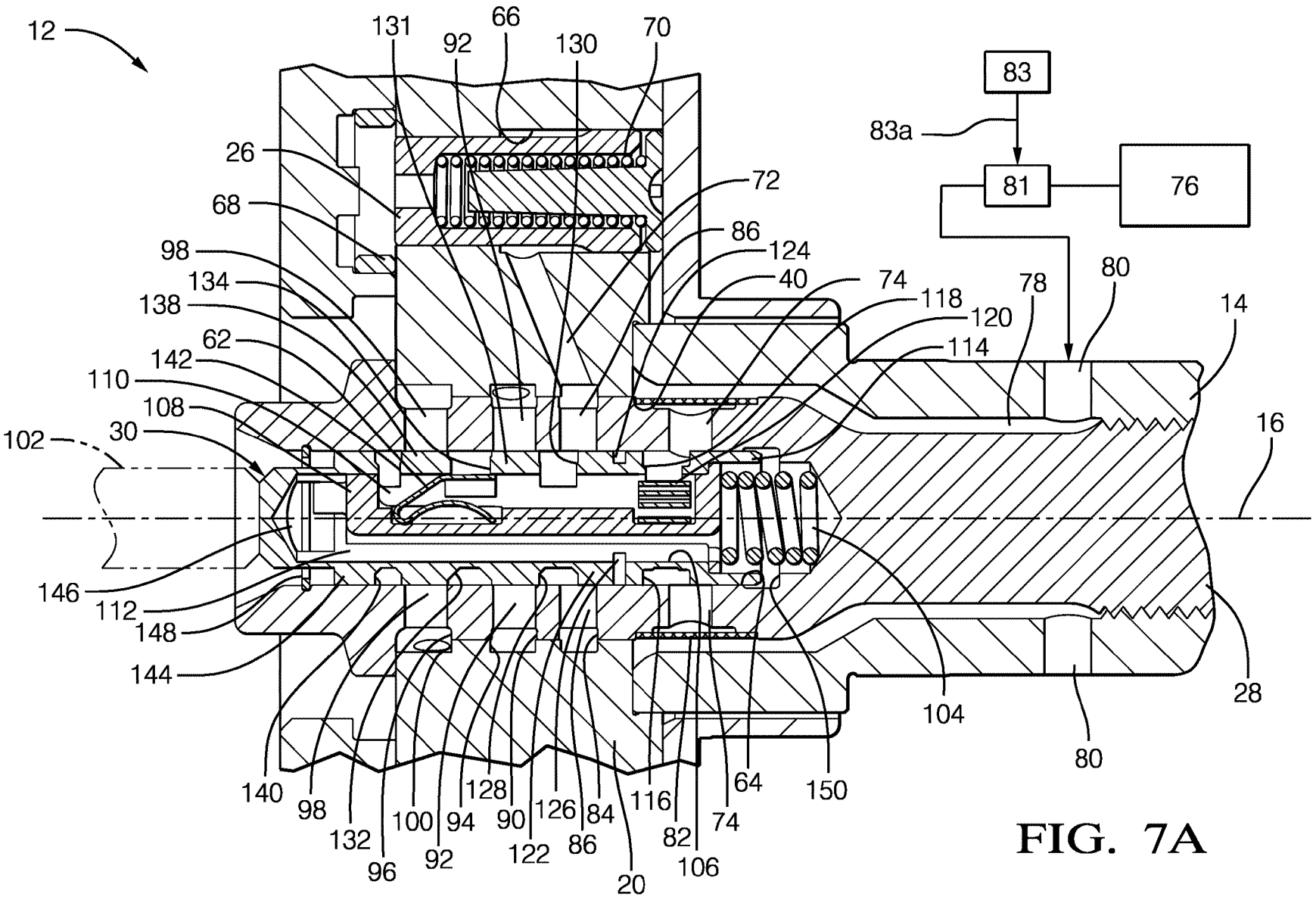
FIG. 7A is the view of FIG. 5A now shown with the valve spool in a hold position now with the lock pin retracted from the lock pin seat.
Figure 7B:
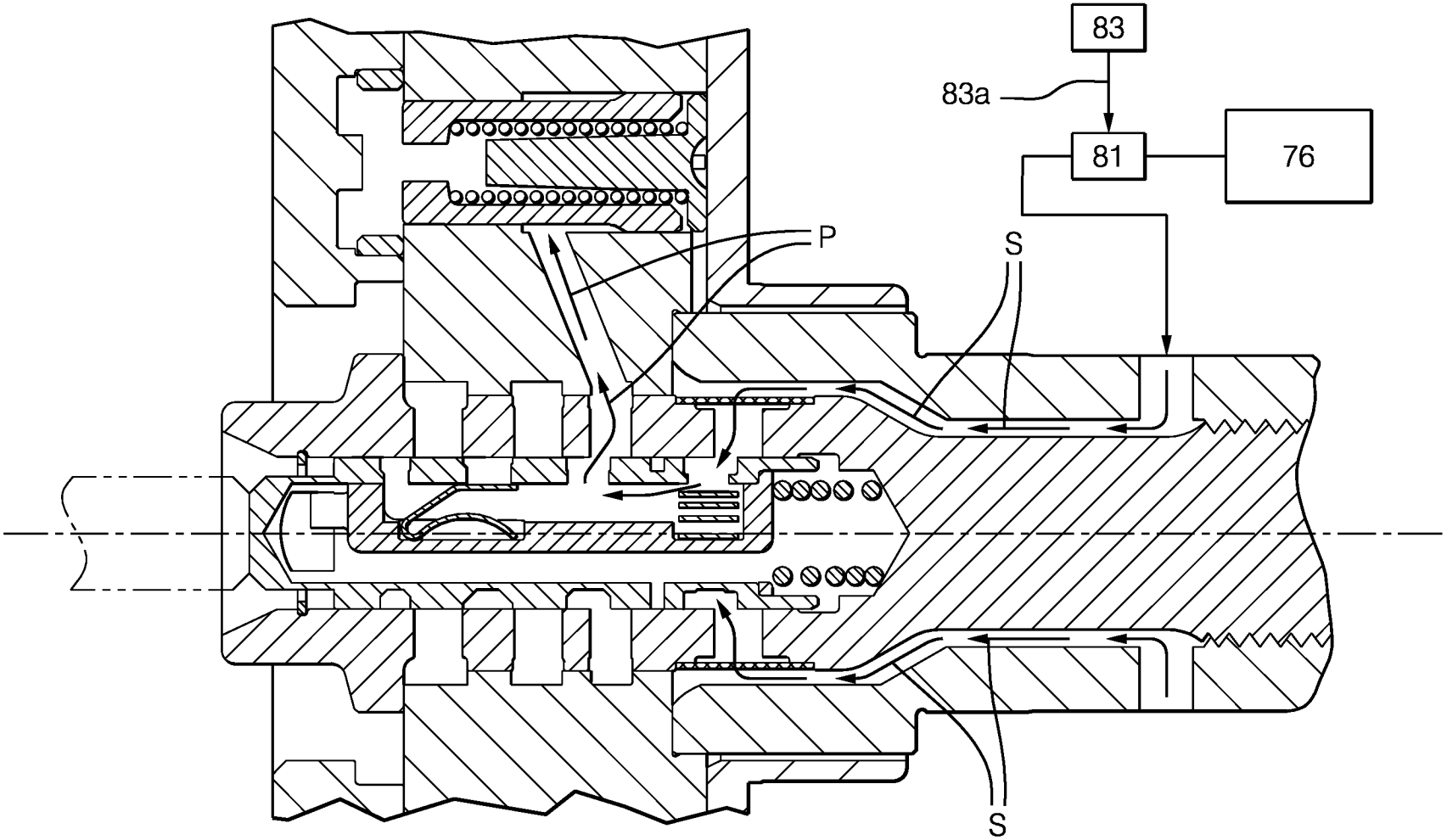
FIG. 7B is the view of FIG. 7A shown with reference numbers removed and arrows added in order to clearly shown the path of travel of oil.

In a hold position, when an electric current of a second magnitude is supplied to actuator 102 as shown in FIGS. 7A and 7B, actuator 102 urges valve spool 30 in a direction toward valve spring 104 thereby causing valve spring 104 to be compressed slightly more than in the advance position. In the hold position, supply land 114 is positioned to open bolt supply passages 74, thereby allowing pressurized oil to be supplied to phasing volume 110 through supply check valve 120 from oil source 76 when pressure within phasing volume 110 is lower than the pressure of oil source 76. Also in the hold position, lock pin land 122 is positioned to prevent fluid communication between bolt lock pin passages 86 and spool annular lock pin groove 124, thereby preventing oil from being vented from lock pin bore 66. In the hold position, lock pin land 122 also opens fluid communication between bolt lock pin passages 86 and phasing volume 110, thereby allowing pressurized oil to be supplied to lock pin bore 66 via spool advance passage 130, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. Also in the hold position, advance land 131 is positioned to block fluid communication between bolt advance passages 92 and spool annular advance groove 128 via spool advance passage 130 while providing restricted fluid communication between bolt advance passages 92 and spool annular recirculation groove 132. Similarly, in the hold position, retard land 138 is positioned to block fluid communication between bolt retard passages 98 and spool annular retard groove 140 via spool retard passage 142 while providing restricted fluid communication between bolt retard passages 98 and spool annular recirculation groove 132. By providing restricted fluid communication between bolt advance passages 92 and spool annular recirculation groove 132 and between bolt retard passages 98 and spool annular recirculation groove 132, the rotational position of rotor 20 and stator 18 is substantially maintained in the hold position. In FIG. 7B, the reference numbers have been removed for clarity and arrows representing the path of travel of the oil have been included where arrows S represent oil from oil source 76 and arrows P represent oil that is pressurized to retract lock pin 26 from lock pin seat 68. It should be noted that FIG. 7B shows supply check valve 120 being open, but may typically remain closed unless lock pin 26 is in the process of being retracted from lock pin seat 68.

Figure 8A:
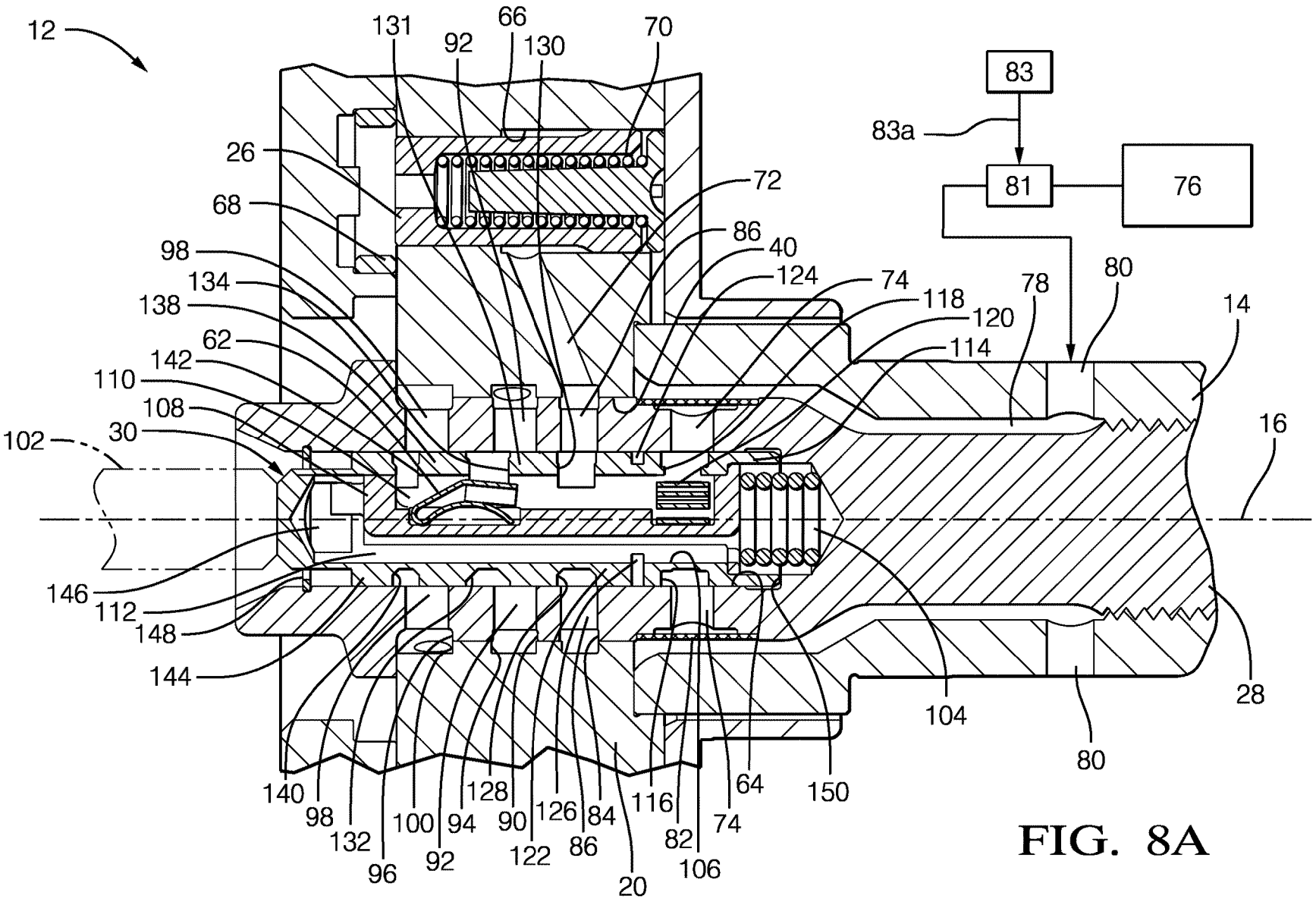
FIG. 8A is the view of FIG. 5A now shown with the valve spool in a retard position now with the lock pin retracted from the lock pin seat.
Figure 8B:
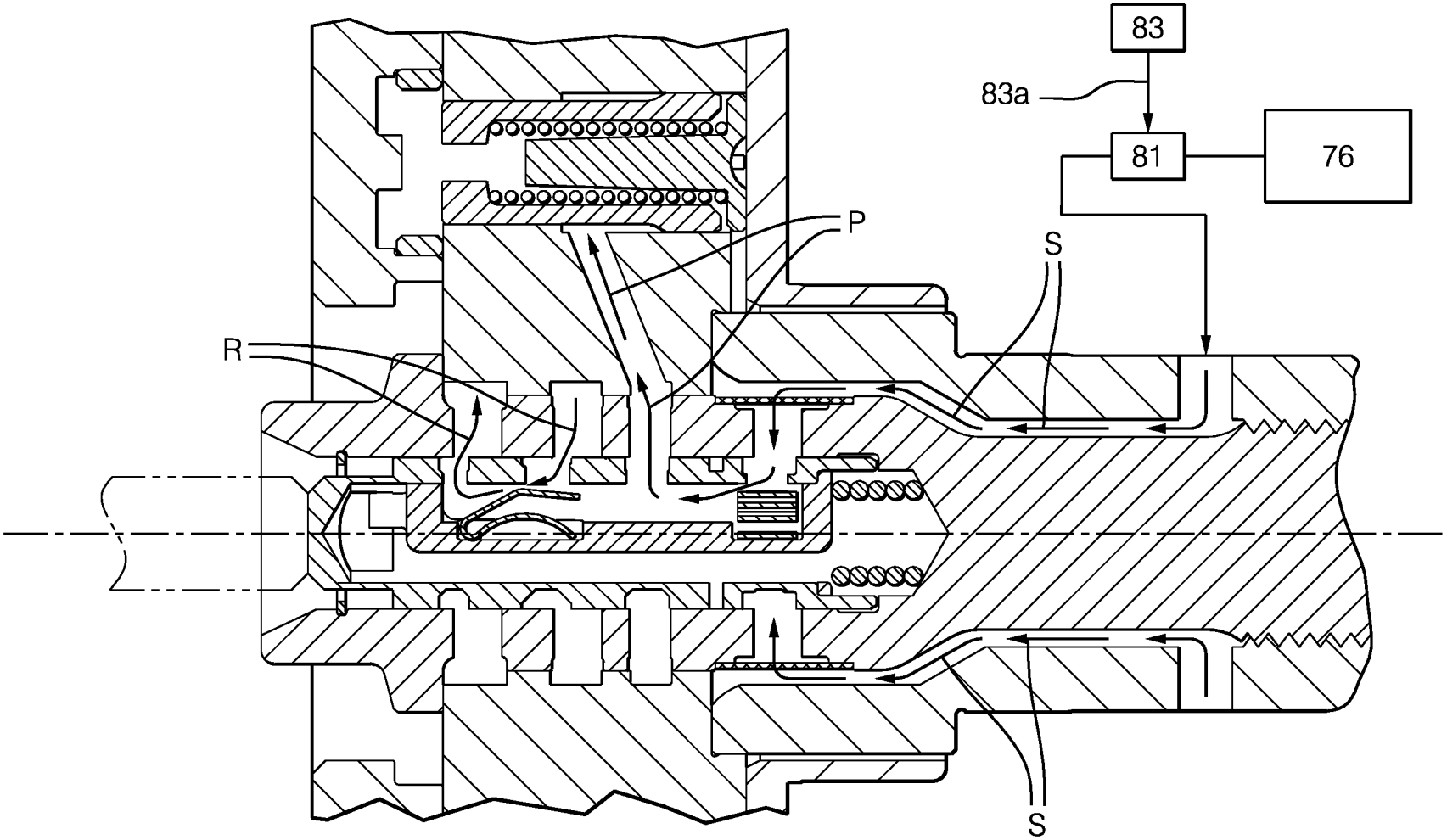
FIG. 8B is the view of FIG. 8A shown with reference numbers removed and arrows added in order to clearly shown the path of travel of oil.

In a retard position, when an electric current of a third magnitude is supplied to actuator 102 as shown in FIGS. 8A and 8B, actuator 102 urges valve spool 30 in a direction toward valve spring 104 thereby causing valve spring 104 to be compressed slightly more than in the hold position until valve spool 30 abuts a second stop member 150, which may be, by way of non-limiting example only, a shoulder formed in valve bore 64. In the retard position, supply land 114 is positioned to open bolt supply passages 74, thereby allowing pressurized oil to be supplied to phasing volume 110 through supply check valve 120 from oil source 76 when pressure within phasing volume 110 is lower than the pressure of oil source 76. Also in the retard position, lock pin land 122 is positioned to prevent fluid communication between bolt lock pin passages 86 and spool annular lock pin groove 124, thereby preventing oil from being vented from lock pin bore 66. In the retard position, lock pin land 122 also opens fluid communication between bolt lock pin passages 86 and phasing volume 110, thereby allowing pressurized oil to be supplied to lock pin bore 66 via spool advance passage 130, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. Also in the retard position, advance land 131 is positioned to permit fluid communication between bolt advance passages 92 and phasing volume 110 via spool annular recirculation groove 132, spool recirculation passage 134, and phasing check valve 62 while retard land 138 is positioned to permit fluid communication between bolt retard passages 98 and phasing volume 110 via spool annular retard groove 140 and spool retard passage 142. However, fluid communication is prevented from bolt advance passages 92 directly to spool annular advance groove 128 and fluid communication is prevented from bolt retard passages 98 directly to spool annular recirculation groove 132. In this way, torque reversals of camshaft 14 that tend to pressurize oil within advance chambers 42*a*, 42*b*, 42*c* cause oil to be vented out of advance chambers 42*a*, 42*b*, 42*c* and to be supplied to retard chambers 44*a*, 44*b*, 44*c* via rotor advance passages 56, rotor annular advance groove 94, bolt annular advance groove 90, bolt advance passages 92, spool annular recirculation groove 132, spool recirculation passage 134, phasing check valve 62, phasing volume 110, spool retard passage 142, spool annular retard groove 140, bolt retard passages 98, bolt annular retard groove 96, rotor annular retard groove 100, and rotor retard passages 58. However, torque reversals of camshaft 14 that tend to pressurize oil within retard chambers 44*a*, 44*b*, 44*c* are prevented from venting oil from retard chambers 44*a*, 44*b*, 44*c* because phasing check valve 62 prevents oil from being supplied to advance chambers 42*a*, 42*b*, 42*c*. It should be noted that oil within advance chamber 42*d* is communicated back to oil source 76 through rotor supply passage 59 by virtue of oil within advance chamber 42*d* becoming elevated to a pressure that is greater than oil source 76 due to the torque reversals of camshaft 14. Consequently, in the retard position, torque reversals of camshaft 14 cause rotor 20 to rotate relative to stator 18 to cause an advance in timing of camshaft 14 relative to the crankshaft. It should be noted that supply check valve 120 prevents oil from being communicated to oil source 76 from phasing volume 110 when torque reversals of camshaft 14 produce oil pressures that are greater than the pressure produced by oil source 76. In FIG. 8B, the reference numbers have been removed for clarity and arrows representing the path of travel of the oil have been included where arrows S represent oil from oil source 76, arrows R represent oil that is being recirculated for rotating rotor 20 relative to stator 18, and arrows P represent oil that is pressurized to retract lock pin 26 from lock pin seat 68. It should be noted that FIG. 8B shows phasing check valve 62 being opened, but phasing check valve 62 may also be closed depending on the direction of the torque reversion of camshaft 14 at a particular time. It should also be noted that supply check valve 120 is shown open in FIG. 8B, but may typically remain closed unless lock pin 26 is in the process of being retracted from lock pin seat 68.

Emphasis will now be made to FIG. 12 in order to better illustrate how advance chamber 42*d* is in constant fluid communication with oil source 76. As can be seen in FIG. 12, rotor supply passage 59 extends from annular oil supply passage 78 which is formed radially between camshaft 14 and camshaft phaser attachment bolt 28. As should now be readily apparent, the location of rotor supply passage 59 allows for continuous fluid communication between advance chamber 42*d* and rotor supply passage 59, thereby providing constant, uninterrupted fluid communication between advance chamber 42*d* and oil source 76, including when rotor 20 moves toward the full advance position and toward the full retard position. It should be noted that valve spool 30 does not affect communication between oil source 76 and advance chamber 42*d* through rotor supply passage 59. It should also be noted that there are no check valves present between advance chamber 42*d* and oil source 76, thereby allowing oil from advance chamber 42*d* to be communicated back to oil source 76 when rotor 20 is being rotated toward the full retard position such that the volume of advance chamber 42*d* is being decreased.

Emphasis will now be made to FIG. 13 in order to better illustrate how rotor vent passage 60 continuously prevents pressurization of retard chamber 44*d*. As can be seen in FIG. 13, rotor vent passage 60 is formed as a notch in the face of rotor 20 such that rotor vent passage 60 extends radially inward sufficiently far so as overlap with front cover central bore 24*a* which extends coaxially through front cover 24. In this way, rotor vent passage 60 and front cover central bore 24*a* provide a vent path which continuously prevents pressurization of retard chamber 44*d* by providing a vent passage from 44*d* to the exterior of camshaft phaser 12, including when rotor 20 moves toward the full advance position and toward the full retard position. While rotor vent passage 60 and front cover central bore 24*a* have been illustrated as the vent passage which continuously prevents pressurization of retard chamber 44*d*, it should be understood that other possibilities of the vent passages exist. By way of non-limiting example only, the vent passage could be formed only through front cover 24 at a location which is aligned with retard chamber 44*d*, only through back cover 22 at a location which is aligned with retard chamber 44*d*, radially outward through stator 18 from retard chamber 44*d*, or a passage or series of passages in rotor 20 and camshaft 14 which lead back to oil source 76.

It should now be readily apparent that advance chamber 42*d* and retard chamber 44*d* do not function in the manner that advance and retard chambers function in prior art camshaft phasers. More specifically, retard chamber 44*d* is only present in order to provide a space for the respective vane 38 to move into when rotor 20 is rotating in the advance direction and advance chamber 42*d* is in constant communication with oil source 76. In this way, advance chamber 42*d* and retard chamber 44*d* work together to provide a hydraulic biasing force to rotor 20 in the direction toward full advance, thereby at least partially offsetting the natural tendency for the sum of advancing and retarding torque reversals to cause a net retard in timing. Furthermore, with the inclusion of pressure regulating valve 81, the hydraulic biasing force provided by advance chamber 42*d* is in constant communication with oil source 76 can be adjusted, thereby taking into account operating conditions of internal combustion engine 10 such as oil temperature and the rotational rate of internal combustion engine 10 since operating conditions of internal combustion engine 10 vary the hydraulic biasing force if left unregulated. While this hydraulic biasing force may slow the rotational rate of rotor 20 relative to stator 18 when moving toward the full retard position, the rotational rate of rotor 20 relative to stator 18 will be increased when moving toward the full advance position. By hydraulically biasing rotor 20 toward the full advance position, a mechanical biasing spring such as disclosed by Lichti et al. in U.S. Pat. No. 8,534,246 may be eliminated or supplemented.

While the advance chamber that is in constant communication with oil source 76 and the retard chamber that is constantly vented has been illustrated as being defined by the same vane 38 of rotor 20, it should now be understood that it is conceivable for the advance chamber that is in constant communication with oil source 76 and the retard chamber that is constantly vented to be defined by different vanes 38 of rotor 20. Furthermore, it should now be understood that additional advance chambers may be in constant fluid communication with oil source 76 and that additional retard chambers may be constantly vented.

As shown in the figures, phasing check valve 62 and supply check valve 120 may each be simple one piece devices that are made of formed sheet metal that is resilient and compliant and captured between insert 108 and valve spool bore 106. While phasing check valve 62 and supply check valve 120 have been shown as being distinct elements, it should now be understood that phasing check valve 62 and supply check valve 120 may be made from a single piece of formed sheet metal such that phasing check valve 62 and supply check valve 120 share a common portion that engages insert 108. It should also now be understood that one or both of phasing check valve 62 and supply check valve 120 may take numerous other forms known in the art of check valves and may include multiple elements such as coil compression springs and balls.

Figure 9:
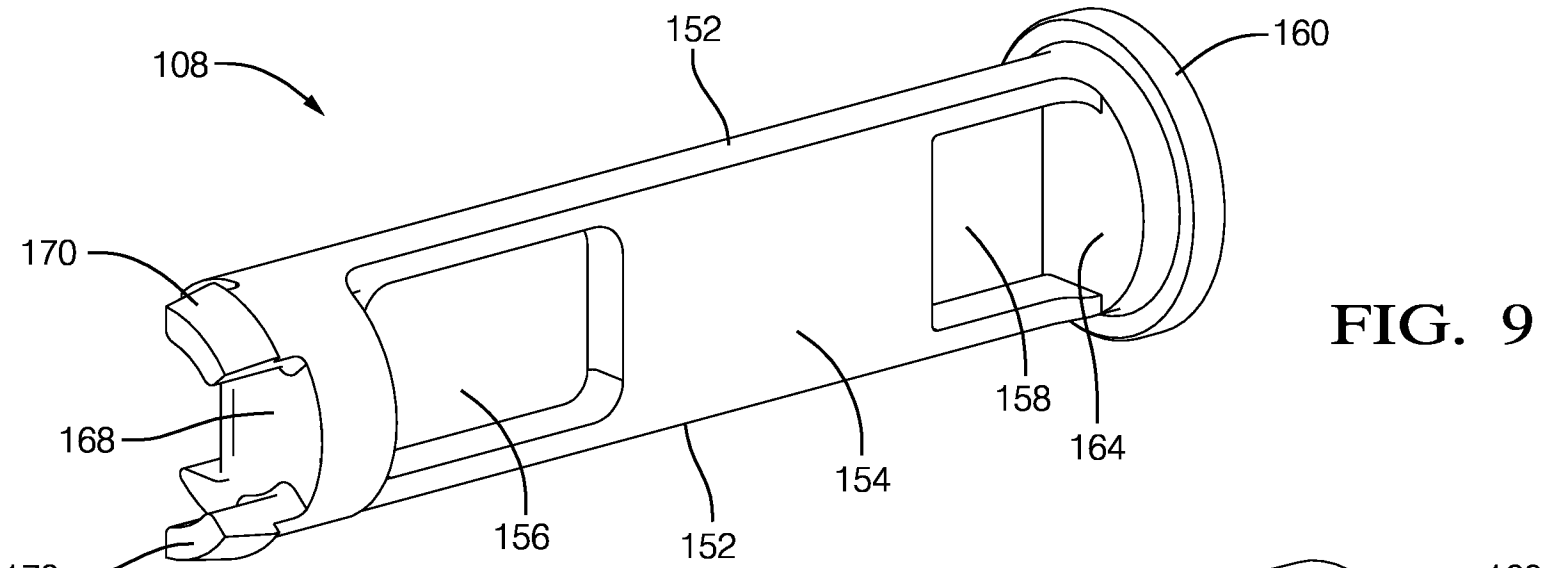
FIGS. 9 and 10 are isometric views of an insert of a valve spool of the camshaft phaser in accordance with the present invention.
Figure 10:
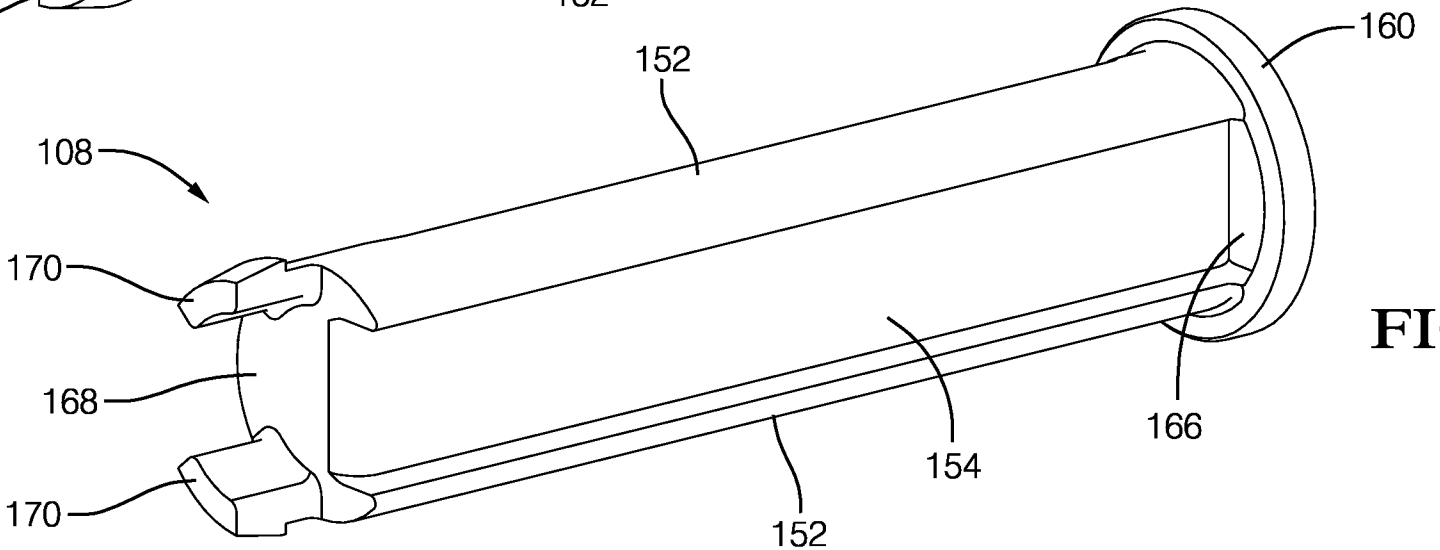
Figure 11:
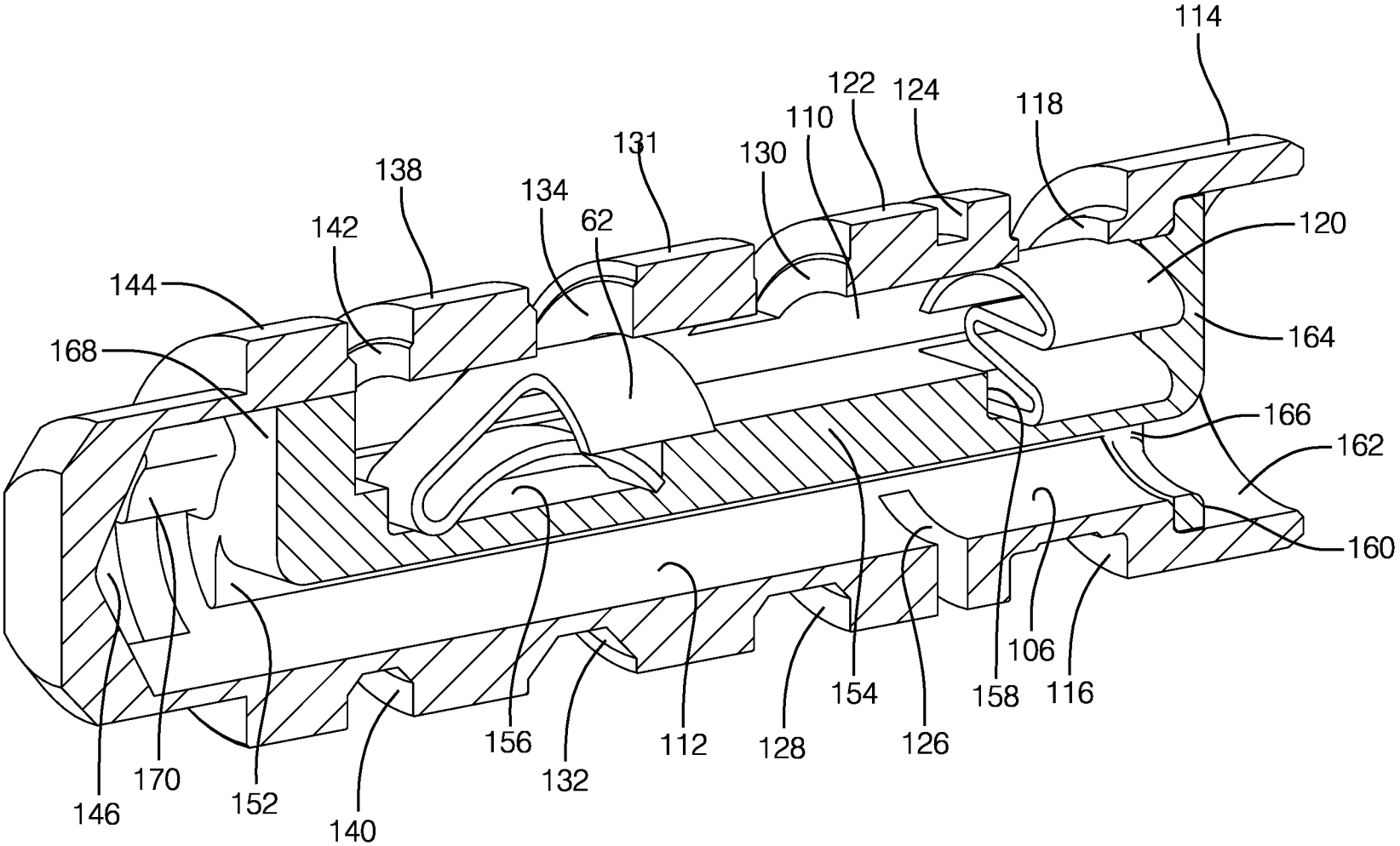
FIG. 11 is an isometric cross-sectional view of the valve spool and the insert of the camshaft phaser in accordance with the present invention.

Insert 108 will now be describe with additional reference to FIGS. 9-11 where FIGS. 9 and 10 are isometric views of insert 108 and FIG. 11 is an isometric axial cross-sectional view of valve spool 30 and insert 108. Insert 108 includes a pair of opposing insert sidewalls 152 which extend axially within valve spool bore 106. Insert sidewalls 152 are contoured to conform to valve spool bore 106 and are spaced apart to allow insert sidewalls 152 to sealingly engage valve spool bore 106 to substantially prevent oil from passing between the interface of insert sidewalls 152 and valve spool bore 106. An insert dividing wall 154 traverses insert sidewalls 152 such that one side of insert dividing wall 154 is laterally offset from valve spool bore 106 and faces toward phasing volume 110 while the other side of insert dividing wall 154 is laterally offset from valve spool bore 106 and faces toward venting volume 112. A phasing check valve pocket 156 and a supply check valve pocket 158 may be defined within the side of insert dividing wall 154 that faces toward phasing volume 110 in order to receive portions of phasing check valve 62 and supply check valve 120 respectively, thereby positively positioning phasing check valve 62 and supply check valve 120 within phasing volume 110. One end of insert sidewalls 152 terminate at a circular insert base 160 which is received within a valve spool counter bore 162 of valve spool bore 106. An insert base end wall 164 is defined between insert base 160 and insert dividing wall 154 to close off one end of phasing volume 110 while an insert base passage 166 is defined between insert base 160 and insert dividing wall 154 to open venting volume 112 to the portion of valve bore 64 that contains valve spring 104 in order to provide a vent path for any oil that may leak thereinto. Insert base 160 may also serve as a spring seat to valve spring 104. An insert end wall 168 is defined at the other end of insert sidewalls 152 in order to close off the other end of phasing volume 110. It should be noted that insert end wall 168 keeps venting volume 112 open to vent passages 146. A pair of insert retention members 170 may extend axially from insert end wall 168 to snap over and engage end land 144 in order to axially retain insert 108 and also to radially orient insert 108 within valve spool bore 106. Alternatively, insert retention members 170 may be omitted because valve spring 104 may be sufficient to retain insert 108 within valve spool bore 106. In the case that insert retention members 170 are omitted, other features may be needed to radially orient insert 108 within valve spool bore 106.

Figure 2:
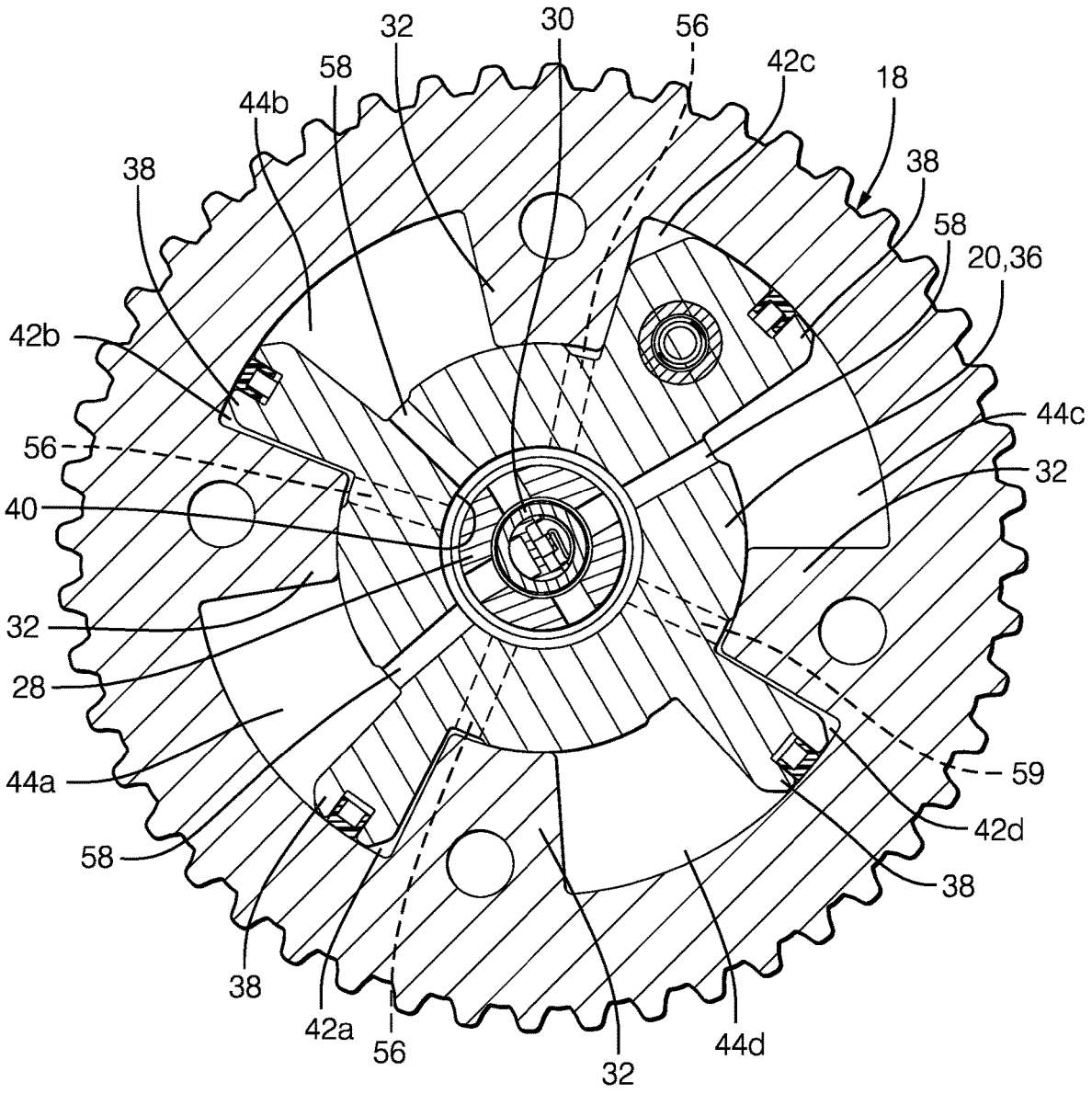
FIG. 2 is a radial cross-sectional view of the camshaft phaser in accordance with the present invention.
Figure 3:
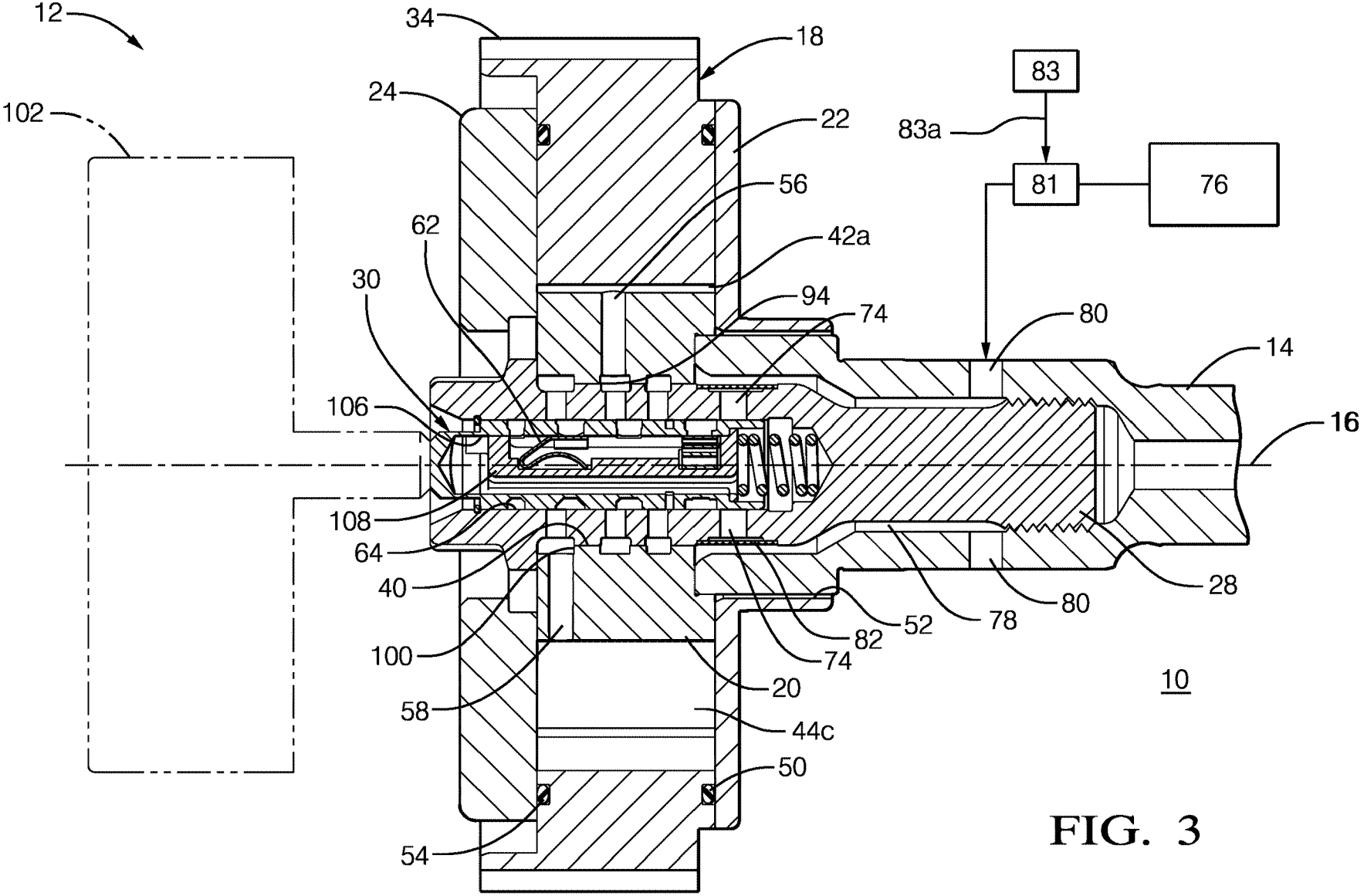
FIG. 3. is an axial cross-sectional view of the camshaft phaser in accordance with the present invention taken through advance and retard passages of a rotor of the camshaft phaser.
Figure 4:
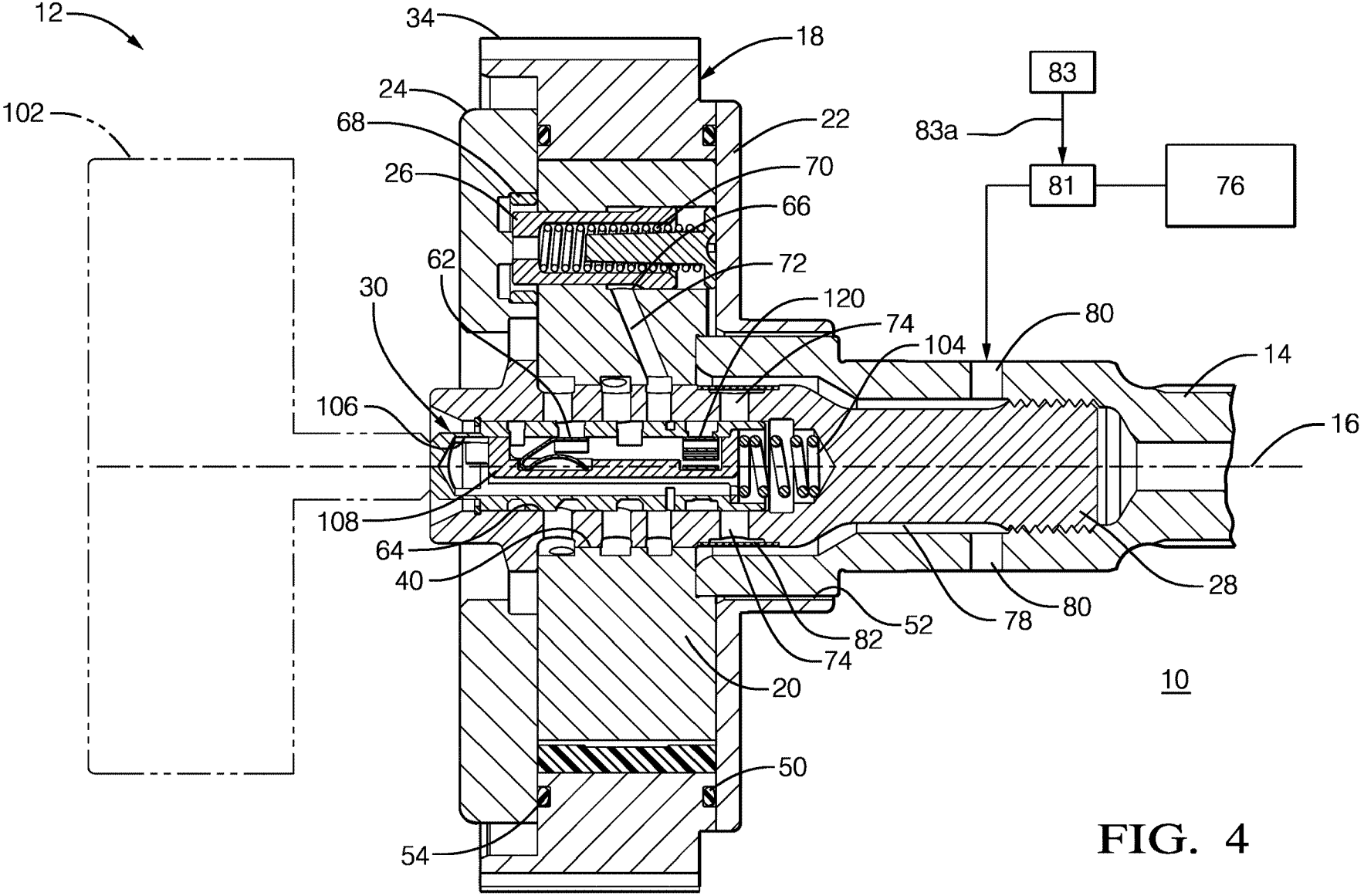
FIG. 4. is an axial cross-sectional view of the camshaft phaser in accordance with the present invention taken through a lock pin of the camshaft phaser.

While camshaft phaser 12 has been described as defaulting to full advance, it should now be understood that camshaft phaser 12 may alternatively default to full retard by simply rearranging oil passages. Similarly, while full advance has been described as full clockwise rotation of rotor 20 within stator 18 as shown in FIG. 2, it should also now be understood that full advance may alternatively be full counterclockwise rotation of rotor 20 within stator 18 depending on whether camshaft phaser 12 is mounted to the front of internal combustion engine 10 (shown in the figures) or to the rear of internal combustion engine 10.

While camshaft phaser 12 has been described herein as including lock pin 26, it should now be understood that lock pin 26 may be omitted. Furthermore, lock pin 26 may be a first lock pin in a staged lock pin system where one lock pin holds the rotor in a range of motion and another lock pin holds the rotor at a predetermined aligned position within the range of motion.

While camshaft phaser attachment bolt 28 has been described herein as including grooves on the outer periphery thereof which are aligned with corresponding grooves formed in rotor central through bore 40 of rotor 20, it should now be understood that the grooves on camshaft phaser attachment bolt 28 could be omitted and the grooves formed in rotor central through bore 40 could be used to serve the same function. Similarly, the grooves formed in rotor central through bore 40 could be omitted and the grooves on camshaft phaser attachment bolt 28 could be used to serve the same function.

Camshaft phaser 12 with advance chamber **42*d* which is in constant fluid communication with oil source 76 and retard chamber 44*d* which is vented to continuously prevent pressurization of retard chamber 44*d* provides a torque actuated camshaft phaser with improved phasing rates in the advance direction as a result of rotor 20** being hydraulically biased toward the full advance position.

While this invention has been described in terms of preferred embodiments thereof, it is not intended to be so limited, but rather only to the extent set forth in the claims that follow.

We claim:

1. A camshaft phaser for use with an internal combustion engine for controllably varying a phase relationship between a crankshaft and a camshaft in said internal combustion engine, said camshaft phaser comprising:

a stator having a plurality of lobes, the stator being configured to connect to said crankshaft of said internal combustion engine so as to provide a fixed ratio of rotation between said stator and said crankshaft;

a rotor coaxially disposed within said stator, said rotor having a plurality of vanes interspersed with said plurality of lobes defining a plurality of advance chambers and a plurality of retard chambers such that said plurality of advance chambers and said plurality of retard chambers are arranged in an alternating pattern and such that said rotor rotates within said stator from a full advance position to a full retard position; and a supply passage in continuous fluid communication with one of said plurality of advance chambers, said supply passage being in continuous fluid communication with an oil source such that said one of said plurality of advance chambers is in fluid communication with said oil source so as to pressurize said one of said plurality of advance chambers when another one of said plurality of advance chambers is vented so as to prevent pressurization of said another one of said plurality of advance chambers.

2. The camshaft phaser as in claim 1 further comprising a vent passage which continuously prevents pressurization of one of said plurality of retard chambers.

3. The camshaft phaser as in claim 2 wherein said vent passage prevents pressurization of said one of said plurality of retard chambers when said rotor is rotating toward said full advance position and when said rotor is rotating toward said full retard position.

4. The camshaft phaser as in claim 2 wherein said one of said plurality of advance chambers is in fluid communication with, and is pressurized by, said oil source when said rotor is rotating toward said full advance position and when said rotor is rotating toward said full retard position.

5. The camshaft phaser as in claim 2 further comprising:

a rotor advance passage in said rotor which allows oil from another one of said plurality of retard chambers to flow into another one of said plurality of advance chambers when said rotor is rotating toward said full advance position;

a rotor retard passage in said rotor which allows oil from said another one of said plurality of advance chambers to flow into said another one of said plurality of retard chambers when said rotor is rotating toward said full retard position.

6. The camshaft phaser as in claim 1 further comprising:

a pressure regulating valve between said oil source and said one of said plurality of advance chambers which regulates pressure of oil supplied to said one of said plurality of advance chambers from said oil source.

7. The camshaft phaser as in claim 6 wherein said pressure regulating valve is in electrical communication with a controller which sends a control signal to said pressure regulating valve, thereby varying the pressure of oil supplied to said one of said plurality of advance chambers from said oil source.

8. A method of using a camshaft phaser for use with an internal combustion engine for controllably varying a phase relationship between a crankshaft and a camshaft in said internal combustion engine, said camshaft phaser comprising a stator having a plurality of lobes, the stator being configured to connect to said crankshaft of said internal combustion engine so as to provide a fixed ratio of rotation between said stator and said crankshaft; a rotor coaxially disposed within said stator, said rotor having a plurality of vanes interspersed with said plurality of lobes defining a plurality of advance chambers and a plurality of retard chambers such that said plurality of advance chambers and said plurality of retard chambers are arranged in an alternating pattern and such that said rotor rotates within said stator from a full advance position to a full retard position; and a supply passage, said method comprising:

using said supply passage to provide continuous fluid communication between one of said plurality of advance chambers and an oil source such that said one of said plurality of advance chambers is in fluid communication with said oil source so as to pressurize said one of said plurality of advance chambers when another one of said plurality of advance chambers is vented so as to prevent pressurization of said another one of said plurality of advance chambers.

9. The method as in claim 8 wherein said camshaft phaser further comprises a vent passage; said method further comprising using said vent passage to continuously prevent pressurization of one of said plurality of retard chambers.

10. The method as in claim 9 further comprising using said vent passage to prevent pressurization of said one of said plurality of retard chambers when said rotor is rotating toward said full advance position and when said rotor is rotating toward said full retard position.

11. The method as in claim 9 further comprising using said supply passage to provide continuous fluid communication between one of said plurality of advance chambers and said oil source such that oil is supplied to said one of said plurality advance chambers when said rotor is rotating toward said full advance position and when said rotor is rotating toward said full retard position.

12. The method as in claim 9 wherein said camshaft phaser further comprises a pressure regulating valve between said oil source and said one of said plurality of advance chambers; said method further comprising using said pressure regulating valve to regulate pressure of oil supplied to said one of said plurality of advance chambers from said oil source.

13. The method as in claim 12 wherein said pressure regulating valve is in electrical communication with a controller; said method further comprising using said controller to send a control signal to said pressure regulating valve which varies the pressure of oil supplied to said one of said plurality of advance chambers from said oil source.

14. A camshaft phaser for use with an internal combustion engine for controllably varying a phase relationship between a crankshaft and a camshaft in said internal combustion engine, said camshaft phaser comprising:

a stator having a plurality of lobes, the stator being configured to connect to said crankshaft of said internal combustion engine so as to provide a fixed ratio of rotation between said stator and said crankshaft;

a rotor coaxially disposed within said stator, said rotor having a plurality of vanes interspersed with said plurality of lobes defining a plurality of advance chambers and a plurality of retard chambers such that said plurality of advance chambers and said plurality of retard chambers are arranged in an alternating pattern and such that said rotor rotates within said stator from a full advance position to a full retard position; and wherein one of said plurality of advance chambers is configured to be in continuous fluid communication with an oil source so as to pressurize said one of said plurality of advance chambers when another one of said plurality of advance chambers is vented so as to prevent pressurization of said another one of said plurality of advance chambers.

15. The camshaft phaser as in claim 14 further comprising a vent passage which prevents pressurization of one of said plurality of retard chambers when said rotor is rotating toward said full advance position and when said rotor is rotating toward said full retard position.

16. The camshaft phaser as in claim 15 wherein said one of said plurality of advance chambers is configured to receive oil from said oil source when said rotor is rotating toward said full advance position and when said rotor is rotating toward said full retard position.

17. The camshaft phaser as in claim 14 wherein said one of said plurality of advance chambers is configured to be pressurized by said oil source when said rotor is rotating toward said full advance position and when said rotor is rotating toward said full retard position.

* * * * *